US010515502B2

(12) United States Patent
Danjo et al.

(10) Patent No.: US 10,515,502 B2
(45) Date of Patent: Dec. 24, 2019

(54) PAPER SHEET HANDLING MACHINE AND PAPER SHEET HANDLING METHOD

(71) Applicant: GLORY LTD., Himeji-shi, Hyogo (JP)

(72) Inventors: Hiroshi Danjo, Hyogo (JP); Yuya Kataoka, Hyogo (JP)

(73) Assignee: GLORY LTD., Himeji-Shi, Hyogo (JP)

( * ) Notice: Subject to any disclaimer, the term of this patent is extended or adjusted under 35 U.S.C. 154(b) by 0 days.

(21) Appl. No.: 15/747,195

(22) PCT Filed: Jun. 10, 2016

(86) PCT No.: PCT/JP2016/067394

§ 371 (c)(1),
(2) Date: Jan. 24, 2018

(87) PCT Pub. No.: WO2017/018075

PCT Pub. Date: Feb. 2, 2017

(65) Prior Publication Data

US 2018/0218558 A1 Aug. 2, 2018

(30) Foreign Application Priority Data

Jul. 24, 2015 (JP) ..... 2015-146608

(51) Int. Cl.
*B65H 7/02* (2006.01)
*G07D 11/18* (2019.01)
(Continued)

(52) U.S. Cl.
CPC ..... *G07D 11/18* (2019.01); *B65H 7/02* (2013.01); *B65H 31/24* (2013.01); *G07D 9/00* (2013.01); *G07D 11/125* (2019.01); *G07D 11/13* (2019.01); *G07D 11/14* (2019.01); *G07D 11/24* (2019.01); *G07D 11/34* (2019.01); *G07D 11/50* (2019.01); *B65H 2701/1912* (2013.01); *G07D 7/00* (2013.01); *G07D 2207/00* (2013.01); *G07D 2211/00* (2013.01)

(58) Field of Classification Search
CPC ..... B65H 7/00; B65H 7/02; B65H 31/24
See application file for complete search history.

(56) References Cited

U.S. PATENT DOCUMENTS 7,278,527 B2 * 10/2007 Daout ..... G07D 11/245 194/206
2004/0093117 A1 5/2004 Daout et al.
(Continued)

FOREIGN PATENT DOCUMENTS

EP 2 234 074 A1 9/2010
JP 8-69553 A 3/1996
(Continued)

OTHER PUBLICATIONS

International Preliminary Report/Written Opinion (International Application No. PCT/JP2016/067394) (8 pages—dated Jan. 30, 2018).
(Continued)

*Primary Examiner* — Howard J Sanders
(74) *Attorney, Agent, or Firm* — Renner Kenner Greive Bobak Taylor and Weber; Tim Hodgkiss; Edward Greive

(57) ABSTRACT

A paper sheet handling machine (for example, banknote handling machine (10)) includes: a recognition unit (18) configured to recognize a paper sheet transported by a transport unit (16); a storage unit (for example, banknote storages (30) or banknote storage cassette (40)) configured to store the paper sheet recognized by the recognition unit (18); a memory unit (54) configured to store a maximum capacity for paper sheets in the storage unit; and a maximum capacity change unit (58) configured to change the maximum capacity stored in the memory unit (54), on the basis of information about a kind of the paper sheet recognized by the recognition unit (18).

19 Claims, 8 Drawing Sheets

(51) Int. Cl.

| | |
|---|---|
| ***G07D 11/13*** | (2019.01) |
| ***G07D 11/14*** | (2019.01) |
| ***G07D 11/24*** | (2019.01) |
| ***G07D 11/125*** | (2019.01) |
| ***G07D 9/00*** | (2006.01) |
| ***B65H 31/24*** | (2006.01) |
| ***G07D 11/34*** | (2019.01) |
| ***G07D 11/50*** | (2019.01) |
| *G07D 7/00* | (2016.01) |

(56) References Cited

U.S. PATENT DOCUMENTS

| | | | |
|---|---|---|---|
| 2004/0205025 | A1 | 10/2004 | Takeuchi et al. |
| 2010/0168902 | A1 | 7/2010 | Mizushima |

FOREIGN PATENT DOCUMENTS

| | | | |
|---|---|---|---|
| JP | 11-272921 | A | 10/1999 |
| JP | 2005-4508 | A | 1/2005 |
| JP | 2005-293389 | A | 10/2005 |
| JP | 2006-69708 | A | 3/2006 |
| JP | 2009-20754 | A | 1/2009 |
| JP | 2013-205907 | A | 10/2013 |

OTHER PUBLICATIONS

Australian Office Action (Application No. 2016300420) (3 pages—dated May 15, 2018).
European Search Report (Application No. 16830180.2—PCT/JP2016/067394) (10 pages—dated Feb. 27, 2019).

* cited by examiner

| PROPORTION (%) OF HYBRID BANKNOTES STORED IN BANKNOTE STORAGE | PROPORTION (%) OF BANKNOTES, OTHER THAN HYBRID BANKNOTES, WHICH ARE STORED IN BANKNOTE STORAGE | MAXIMUM CAPACITY |
|---|---|---|
| 0 | 100 | 500 |
| 10 | 90 | 470 |
| 20 | 80 | 440 |
| 30 | 70 | 410 |
| 40 | 60 | 380 |
| 50 | 50 | 350 |
| 60 | 40 | 320 |
| 70 | 30 | 290 |
| 80 | 20 | 260 |
| 90 | 10 | 230 |
| 100 | 0 | 200 |

FIG. 6

PAPER SHEET HANDLING MACHINE AND PAPER SHEET HANDLING METHOD

TECHNICAL FIELD

The present invention relates to a paper sheet handling machine that performs handling of paper sheets such as banknotes, securities, checks, and tickets, and a paper sheet handling method performed by the paper sheet handling machine.

BACKGROUND ART

To date, a paper sheet handling machine that performs depositing of paper sheets such as banknotes, securities, checks, and tickets, or performs depositing and dispensing of the paper sheets, has been widely used. For such a paper sheet handling machine, various types of storage units in which paper sheets inserted into the machine are stored, are used. For example, a tape-type storage unit in which paper sheets are stored on a rotary body by the paper sheets being wound around the outer circumferential surface of the rotary body such as a drum with the use of a band-like tape is disclosed in Japanese Laid-Open Patent Publication No. 2006-69708. Furthermore, a stacker-type storage unit in which paper sheets are stacked in a layered state is disclosed in Japanese Laid-Open Patent Publication No. 2013-205907. In a paper sheet handling machine using such a storage unit, for example, the maximum capacity (for example, the number of fully stored paper sheets) for paper sheets in the storage unit is set, and the maximum capacity is stored for each storage unit in a memory unit. Furthermore, a paper sheet handling machine in which a full storage capacity is preset as a fully stored amount for a storage unit is disclosed in Japanese Laid-Open Patent Publication No. 2005-4508.

SUMMARY OF THE INVENTION

In recent years, depositing of various kinds of paper sheets is performed by the paper sheet handling machine as described above. For example, in depositing of paper sheets, fit notes and unfit notes having the same denomination or face value are inserted into the machine in a mixed state, new version notes and old version notes having the same denomination or face value are inserted into the machine in a mixed state, or paper sheets having different denominations or face values are inserted into the machine. In this case, various kinds of paper sheets are stored in the storage unit. However, properties of paper sheets are different for each kind of the paper sheet, and an amount of paper sheets which can be stored in the storage unit may become less than the maximum capacity allocated to the storage unit, depending on the kind of the paper sheet to be stored in the storage unit. For example, a problem arises that, in a case where unfit notes are stored in the storage unit, an amount of the unfit notes which can be stored in the storage unit is reduced as compared to fit notes since the unfit notes have been greatly damaged and have become bulky.

Furthermore, in recent years, use of hybrid banknotes in which paper and polymer films are combined, is started in some countries and regions. Specifically, a hybrid banknote is formed by a polymer film being adhered to a part of a banknote. Alternatively, a hybrid banknote may be formed by a polymer film that extends linearly along the short edge direction of a banknote being sandwiched between paired paper pieces. However, the polymer film of the hybrid banknote or a portion, of the hybrid banknote, to which the polymer film is adhered has a stronger stiffness than the paper pieces, and the thickness of the polymer film of the hybrid banknote or the thickness of a portion, of the hybrid banknote, to which the polymer film is adhered is greater than the thickness of the paper piece. Therefore, a problem arises that an amount of the hybrid banknotes stored in the tape-type or stacker-type storage unit is reduced as compared to a stored amount of conventional banknotes formed merely from paper. Thus, in a case where the maximum capacity (specifically, the maximum capacity for conventional banknotes formed merely from paper) for banknotes in the storage unit is set in the banknote handling machine, the same amount of hybrid banknotes as the amount of conventional banknotes formed merely from paper cannot be stored in the storage unit. If a large amount of hybrid banknotes are stored in the storage unit, trouble such as overflow of banknotes from the storage unit may occur.

The present invention is made in view of such a problem, and an object of the present invention is to provide a paper sheet handling machine and a paper sheet handling method that allow various kinds of paper sheets to be deposited by changing the maximum capacity for paper sheets that are stored in a storage unit, from an initial value, depending on a kind of a paper sheet stored in the storage unit, and that can also prevent trouble such as overflow of paper sheets from the storage unit.

Another object of the present invention is to provide a paper sheet handling machine and a paper sheet handling method that allow a paper sheet that is temporarily stored in a temporary storage unit to be assuredly stored in a storage unit without, for example, rejecting the paper sheet.

A paper sheet handling machine of the present invention includes: an inlet unit in which a paper sheet is inserted, the inlet unit configured to have a feeding mechanism that feeds an inserted paper sheet into the machine; a transport unit configured to transport the paper sheet that is fed into the machine by the feeding mechanism; a recognition unit configured to recognize the paper sheet transported by the transport unit; a storage unit configured to store the paper sheet recognized by the recognition unit; a memory unit configured to store a maximum capacity for paper sheets in the storage unit; and a maximum capacity change unit configured to change the maximum capacity stored in the memory unit, on the basis of information about a kind of the paper sheet recognized by the recognition unit.

The paper sheet handling machine described above may further include a control unit configured to control the transport unit, and the control unit controls the transport unit such that an amount of paper sheets stored in the storage unit does not exceed the maximum capacity stored in the memory unit. That is, the control unit may control the transport unit so that the paper sheet is not transported to the storage unit in which the storage capacity of the paper sheet has reached a maximum capacity stored in the memory unit, or may control the transport unit so as not to send the paper sheet to the storage unit immediately before the storage amount reaches the maximum capacity stored in the memory unit.

In the paper sheet handling machine described above, the recognition unit may determine whether or not a paper sheet transported by the transport unit is a specific kind of paper sheet, and the maximum capacity change unit may change the maximum capacity stored in the memory unit, on the basis of a proportion between: an amount of the specific kind of paper sheets stored in the storage unit; and an amount of paper sheets, other than the specific kind of paper sheets, which are stored in the storage unit.

Alternatively, the recognition unit may determine whether or not a paper sheet transported by the transport unit is a specific kind of paper sheet, and the maximum capacity change unit may change the maximum capacity stored in the memory unit, on the basis of a difference between: an amount of the specific kind of paper sheets stored in the storage unit; and an amount of paper sheets, other than the specific kind of paper sheets, which are stored in the storage unit.

Alternatively, the recognition unit may determine whether or not a paper sheet transported by the transport unit is a specific kind of paper sheet, and the maximum capacity change unit may change the maximum capacity stored in the memory unit, on the basis of an amount of the specific kind of paper sheets stored in the storage unit.

In this case, the maximum capacity change unit may change the maximum capacity stored in the memory unit when an amount of the specific kind of paper sheets stored in the storage unit reaches a predetermined amount.

In addition, when the recognition unit detects that a paper sheet transported by the transport unit includes a predetermined specific portion, the recognition unit may determine that the paper sheet is the specific kind of paper sheet.

Alternatively, when the recognition unit detects that a paper sheet transported by the transport unit includes a polymer film portion, the recognition unit may determine that the paper sheet is the specific kind of paper sheet.

Alternatively, the recognition unit may also detect an orientation of a paper sheet transported by the transport unit, and when the recognition unit detects that a paper sheet transported by the transport unit includes a predetermined specific portion and that the orientation of the paper sheet is a predetermined orientation, the recognition unit may determine that the paper sheet is the specific kind of paper sheet.

In the paper sheet handling machine described above, the storage unit may be removable from the machine, and the memory unit is provided in the storage unit, and the paper sheet handling machine may further include a reading unit configured to read information stored in the memory unit when the storage unit is mounted in the machine.

In this case, a plurality of storage units may be provided as the storage unit, the plurality of storage units may include a storage unit that is used for storing the specific kind of paper sheets and a storage unit that is not used for storing the specific kind of paper sheets, and the maximum capacity stored in the memory unit provided in the storage unit that is used for storing the specific kind of paper sheets may be less than the maximum capacity stored in the memory unit provided in the storage unit that is not used for storing the specific kind of paper sheets.

In the paper sheet handling machine described above, the storage unit may be removable from the machine, and an identification terminal that allows the storage unit to be identified is provided in the storage unit, and the paper sheet handling machine may further include: a reading unit configured to read identification information of the identification terminal when the storage unit is mounted in the machine, and a maximum capacity setting unit configured to set the maximum capacity to be stored in the memory unit, on the basis of the identification information read by the reading unit.

In this case, the identification information of the identification terminal may include information indicating whether or not the specific kind of paper sheets can be stored, and the maximum capacity setting unit may set the maximum capacity to be stored in the memory unit such that the maximum capacity of the storage unit that is used for storing the specific kind of paper sheets is less than the maximum capacity of the storage unit which is not used for storing the specific kind of paper sheets.

The paper sheet handling machine described above may further include a display unit configured to display information stored in the memory unit.

In this case, when the maximum capacity stored in the memory unit is changed, information indicating that the maximum capacity stored in the memory unit has been changed may be displayed on the display unit.

A paper sheet handling machine of the present invention includes: an inlet unit in which a paper sheet is inserted, the inlet unit configured to have a feeding mechanism that feeds an inserted paper sheet into the machine; a transport unit configured to transport the paper sheet that is fed into the machine by the feeding mechanism; a recognition unit configured to recognize the paper sheet transported by the transport unit; a temporary storage unit configured to temporarily store the paper sheet recognized by the recognition unit; a storage unit configured to store the paper sheet having been temporarily stored in the temporary storage unit; a memory unit configured to store a maximum capacity for paper sheets in the storage unit; and a control unit configured to control the transport unit such that an operation of transporting the paper sheet recognized by the recognition unit, to the temporary storage unit, is selectively regulated on the basis of information about the maximum capacity stored in the memory unit, an amount of paper sheets stored in the storage unit, and a kind of a paper sheet that is temporarily stored in the temporary storage unit.

In the paper sheet handling machine described above, the control unit may control the transport unit such that, in a case where a paper sheet recognized by the recognition unit is to be stored in the storage unit corresponding to a kind of the paper sheet recognized by the recognition unit, when a state where paper sheets are stored in the storage unit is assumed to be a predetermined state, a paper sheet of the kind recognized by the recognition unit is not transported to the temporary storage unit.

Alternatively, the control unit may control the transport unit such that, in a case where a paper sheet recognized by the recognition unit is to be stored in the storage unit corresponding to a kind of the paper sheet recognized by the recognition unit, when a state where paper sheets are stored in the storage unit is assumed to be a predetermined state, no paper sheet is transported to the temporary storage unit.

A paper sheet handling method of the present invention includes: previously storing, in a memory unit, a maximum capacity for paper sheets in a storage unit; feeding a paper sheet inserted in an inlet unit, into a machine; transporting the paper sheet fed into the machine, and recognizing the paper sheet by a recognition unit; storing the paper sheet recognized by the recognition unit, in the storage unit; and changing the maximum capacity stored in the memory unit, on the basis of information about a kind of the paper sheet recognized by the recognition unit.

A paper sheet handling method of the present invention includes: previously storing, in a memory unit, a maximum capacity for paper sheets in a storage unit; feeding a paper sheet inserted in an inlet unit, into a machine; transporting the paper sheet fed into the machine, and recognizing the paper sheet by a recognition unit; temporarily storing the paper sheet recognized by the recognition unit, in an temporary storage unit; and storing, in the storage unit, the paper sheet having been temporarily stored in the temporary storage unit, wherein an operation of transporting the paper sheet recognized by the recognition unit, to the temporary storage unit, is selectively regulated on the basis of information about the maximum capacity stored in the memory unit, an amount of paper sheets stored in the storage unit, and a kind of a paper sheet that is temporarily stored in the temporary storage unit.

BRIEF DESCRIPTION OF THE DRAWINGS

FIG. 6 illustrates a table indicating a relationship among a proportion of hybrid banknotes stored in a banknote storage, a proportion of banknotes, in the banknote storage, other than the hybrid banknotes, and a maximum capacity for banknotes in the banknote storage, in the banknote handling machine shown in FIG. 1;

DESCRIPTION OF THE PREFERRED EMBODIMENTS

Figure 1:
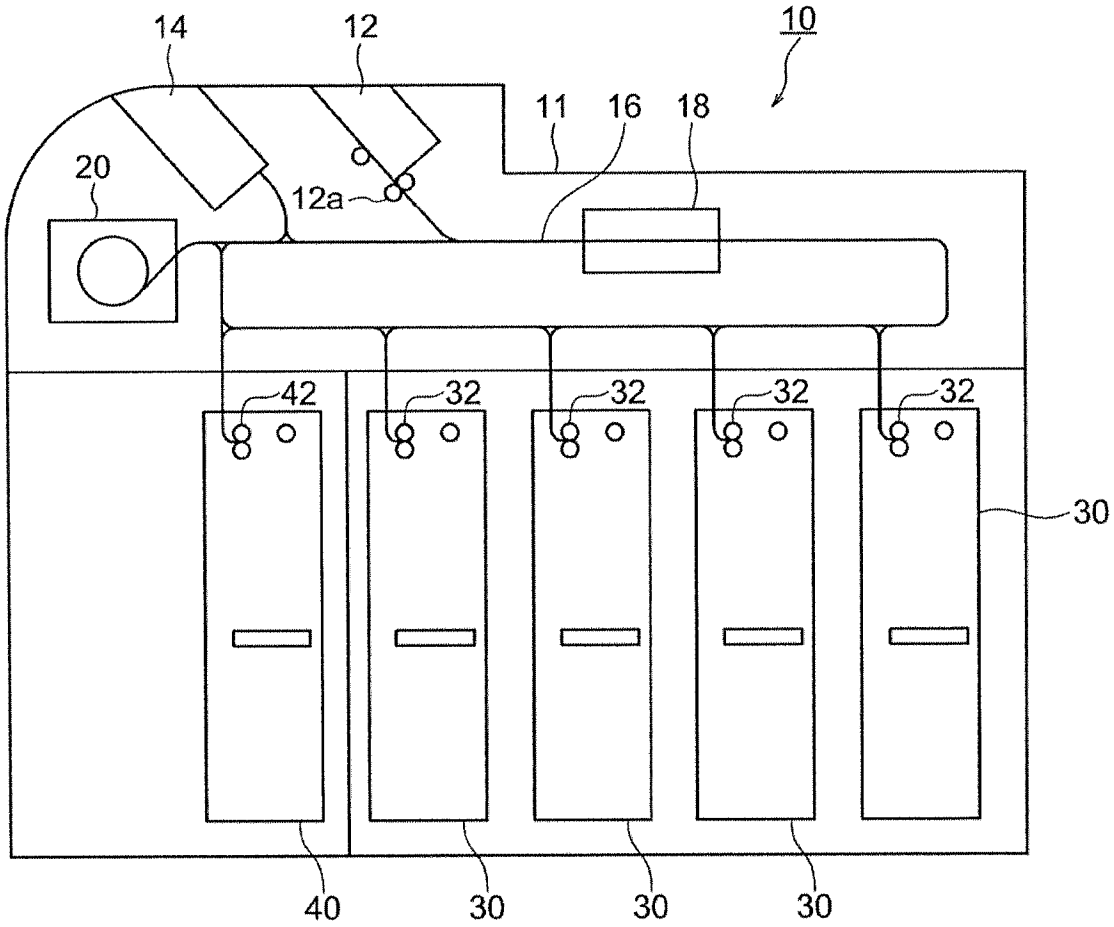
FIG. 1 schematically illustrates an example of a structure of a banknote handling machine according to an embodiment of the present invention.
Figure 2:
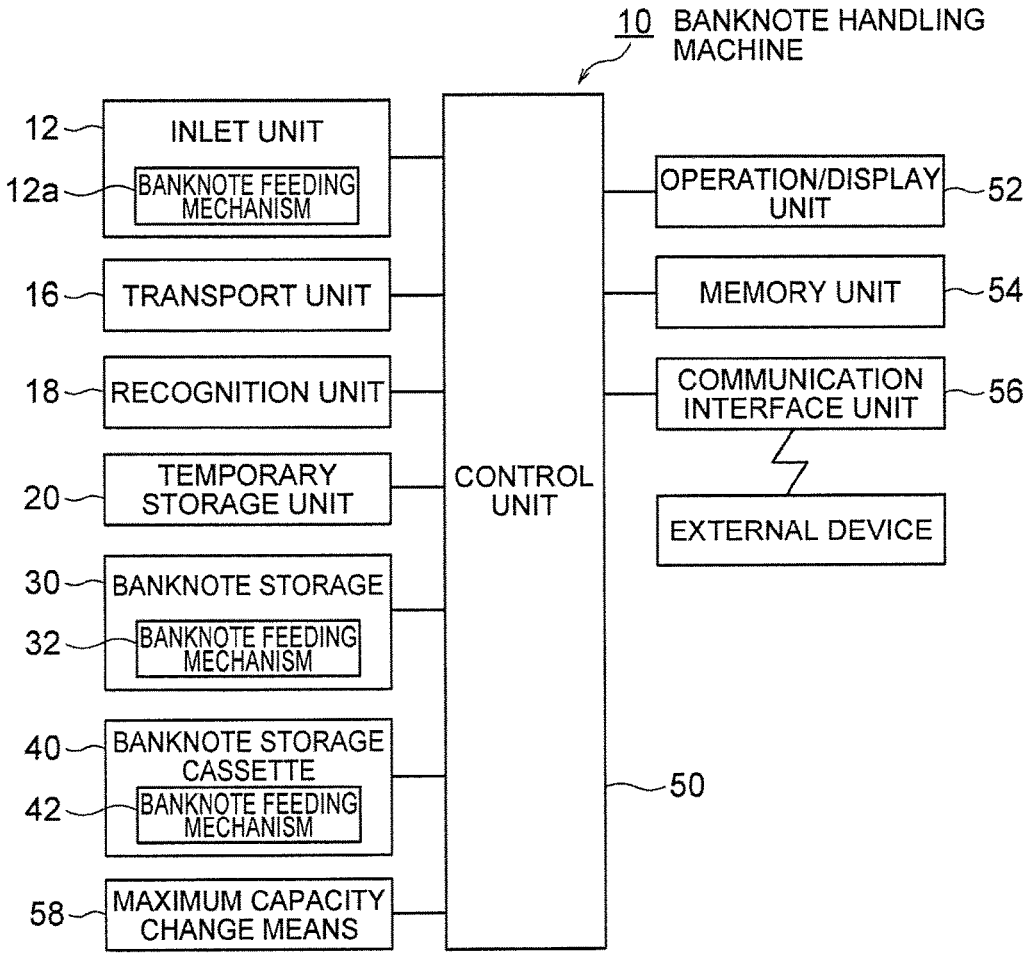
FIG. 2 is a functional block diagram illustrating a configuration of a control system of the banknote handling machine shown in FIG. 1.
Figure 3:
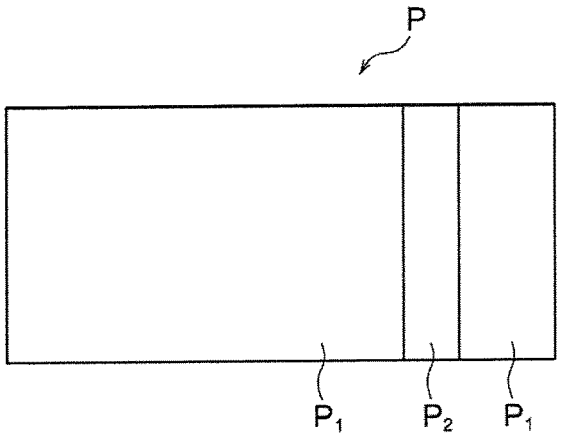
FIG. 3 illustrates a structure of a hybrid banknote to be handled by the banknote handling machine shown in FIG. 1.
Figure 4:
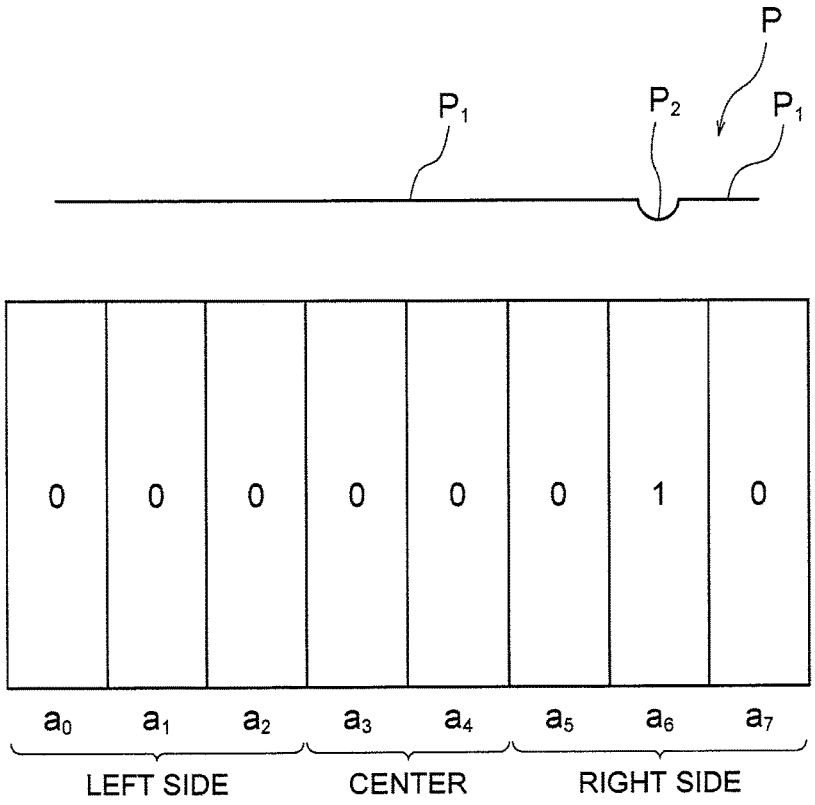
FIG. 4 illustrates a method, performed by a recognition unit of the banknote handling machine shown in FIG. 1, for detecting a position, in a width direction, of a polymer film portion of the hybrid banknote.
Figure 5:
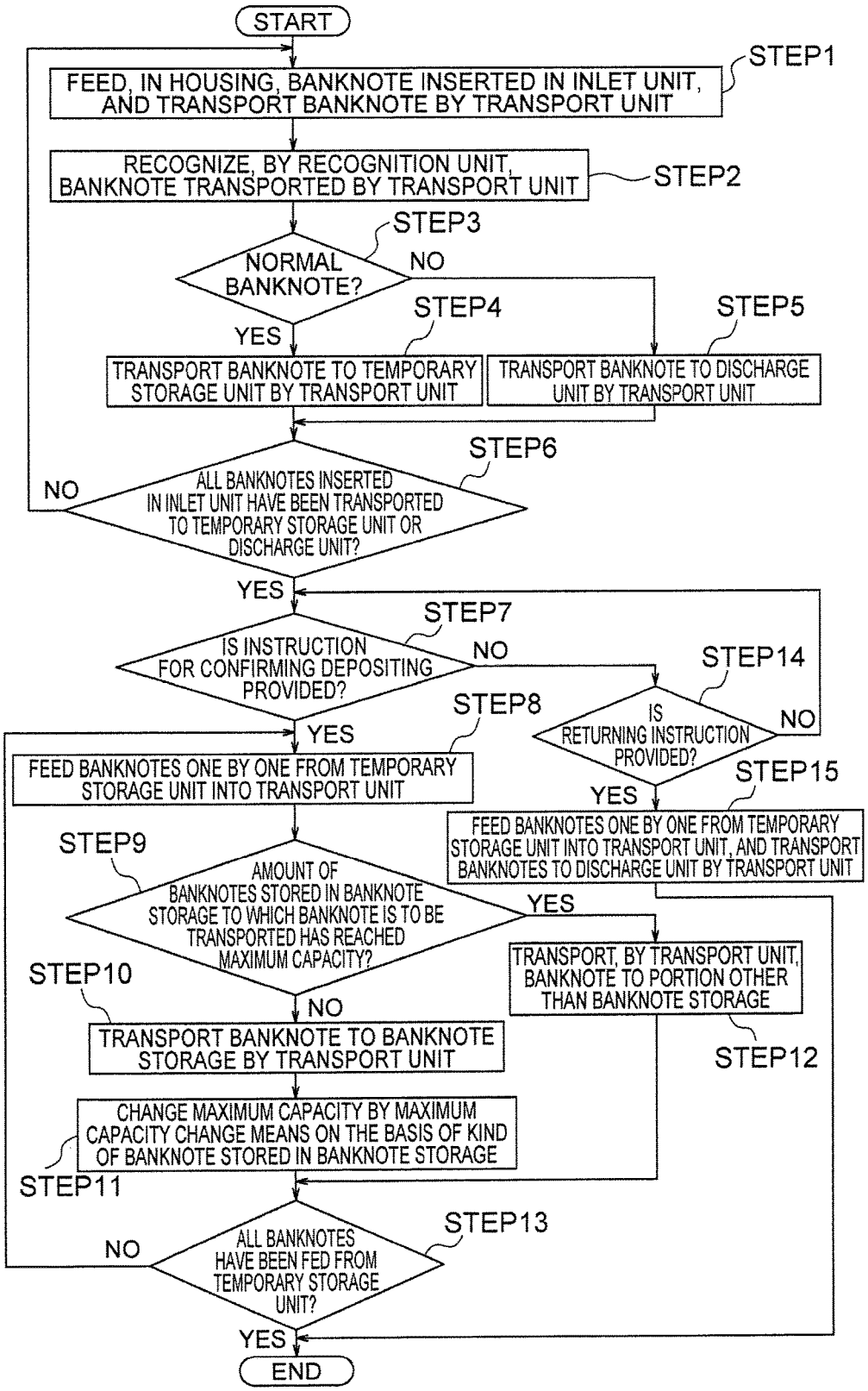
FIG. 5 is a flow chart showing an example of an operation performed by the banknote handling machine shown in FIG. 1 when depositing of banknotes is performed.

Hereinafter, an embodiment of the present invention will be described with reference to the drawings. FIG. 1 to FIG. 6 illustrate a banknote handling machine and a banknote handling method performed by the banknote handling machine according to the present embodiment. Among them, FIG. 1 schematically illustrates an example of a structure of the banknote handling machine according to the present embodiment, and FIG. 2 is a functional block diagram illustrating a configuration of a control system of the banknote handling machine shown in FIG. 1. Furthermore, FIG. 3 illustrates a structure of a hybrid banknote to be handled by the banknote handling machine shown in FIG. 1, and FIG. 4 illustrates a method, performed by a recognition unit of the banknote handling machine shown in FIG. 1, for detecting a position, in a width direction, of a polymer film portion of the hybrid banknote. Furthermore, FIG. 5 is a flow chart showing an example of an operation performed by the banknote handling machine shown in FIG. 1 when depositing of banknotes is performed. Furthermore, FIG. 6 illustrates a table indicating a relationship among a proportion of hybrid banknotes stored in a banknote storage, a proportion of banknotes, in the banknote storage, other than the hybrid banknotes, and a maximum capacity for banknotes in the banknote storage, in the banknote handling machine shown in FIG. 1.

As shown in FIG. 1, a banknote handling machine 10 according to the present embodiment includes a housing 11 having an almost rectangular parallelepiped shape, an inlet unit 12 through which a banknote is inserted into the housing 11 from the outside, and a discharge unit 14 through which a banknote is discharged from the housing 11 to the outside. Furthermore, a transport unit 16 that transports banknotes one by one is provided in the housing 11 of the banknote handling machine 10. The inlet unit 12 is implemented by a hopper or the like into which a plurality of banknotes are inserted by an operator. The inlet unit 12 includes a banknote feeding mechanism 12*a* that feeds the inserted banknotes one by one into the housing 11 and sends the banknotes to the transport unit 16. In such a structure, the banknotes inserted in the inlet unit 12 are fed one by one into the housing 11 and sent to the transport unit 16 by the banknote feeding mechanism 12*a*, and are thereafter transported one by one in the housing 11 by the transport unit 16. In the present embodiment, a plurality of banknotes are inserted in the inlet unit 12 along the short edge direction of the banknotes, and the transport unit 16 transports the banknotes along the short edge direction.

Furthermore, a recognition unit 18 is provided in the transport unit 16, and the recognition unit 18 performs recognition of a denomination, authenticity, face/back, fitness/unfitness, old/new version, a transport state, and the like of the banknote transported by the transport unit 16. Furthermore, a temporary storage unit 20 is connected to the transport unit 16, and a banknote recognized by the recognition unit 18 is transported to the temporary storage unit 20 by the transport unit 16, and temporarily stored in the temporary storage unit 20. In the present embodiment, as the temporary storage unit 20, a tape-type temporary storage unit, in which banknotes are stored on a rotary body by the banknotes being wound around the outer circumferential surface of the rotary body such as a drum with the use of a band-like tape, is used.

Furthermore, as shown in FIG. 1, a plurality (four in the example shown in FIG. 1) of banknote storages 30 are arranged in parallel with each other in the housing 11 of the banknote handling machine 10, and each banknote storage 30 is connected to the transport unit 16. In each banknote storage 30, a plurality of banknotes are stacked in a layered state. Furthermore, in the banknote storages 30, banknotes are stored for each denomination. In such a structure, banknotes that are temporarily stored in the temporary storage unit 20 are fed from the temporary storage unit 20 into the transport unit 16 on the basis of the result of recognition of the banknotes by the recognition unit 18, and transported to the banknote storages 30 for each denomination by the transport unit 16. Furthermore, each banknote storage 30 includes a banknote feeding mechanism 32 that feeds banknotes stored in the banknote storage 30 one by one into the transport unit 16.

Furthermore, as shown in FIG. 1, a banknote storage cassette 40 is detachably mounted in the housing 11 of the banknote handling machine 10. In the banknote storage cassette 40, a plurality of banknotes are stacked in a layered state. Moreover, when the banknote storage cassette 40 is mounted in the housing 11, a banknote is transported to the banknote storage cassette 40 by the transport unit 16. After banknotes have been stored in the banknote storage cassette 40, the banknote storage cassette 40 is taken out from the housing 11, whereby an operator is allowed to collect the banknotes together with the banknote storage cassette 40 from the banknote handling machine 10. Furthermore, the banknote storage cassette 40 includes a banknote feeding mechanism 42 that feeds banknotes stored in the banknote storage cassette 40, one by one, to the transport unit 16 when the banknote storage cassette 40 is mounted in the housing 11. In such a structure, when the banknote storage cassette 40 having banknotes stored therein is mounted in the housing 11, the banknotes can be supplied from the banknote storage cassette 40 to each banknote storage 30 to refill the banknote storage 30.

Furthermore, as shown in FIG. 2, the banknote handling machine 10 of the present embodiment includes a control unit 50 that controls components of the banknote handling machine 10. More specifically, to the control unit 50, the banknote feeding mechanism 12*a* provided in the inlet unit 12, the transport unit 16, the recognition unit 18, the temporary storage unit 20, the banknote feeding mechanism 32 provided in each banknote storage 30, the banknote feeding mechanism 42 provided in the banknote storage cassette 40 that is mounted in the housing 11, and the like are connected. A signal associated with a result of recognition of the banknote by the recognition unit 18 is transmitted to the control unit 50, and the control unit 50 transmits an instruction signal to the components of the banknote handling machine 10, thereby controlling operations of the components.

Furthermore, as shown in FIG. 2, to the control unit 50, an operation/display unit 52, a memory unit 54, and a communication interface unit 56 are connected. The operation/display unit 52 is implemented by, for example, a touch panel provided on the upper surface of the housing 11. Information about a handling state such as depositing of banknotes in the banknote handling machine 10, an inventory amount of banknotes stored in each banknote storage 30 or the banknote storage cassette 40, and the like is displayed on the operation/display unit 52. Moreover, an operator operates the operation/display unit 52, to provide the control unit 50 with various instructions.

The memory unit 54 is implemented by, for example, a memory provided in the housing 11, and information about: handling history such as depositing of banknotes in the banknote handling machine 10; an inventory amount of banknotes stored in each banknote storage 30 or the banknote storage cassette 40; and the like is stored in the memory unit 54. Moreover, the maximum capacity for banknotes in each banknote storage 30 and the maximum capacity for banknotes in the banknote storage cassette 40 mounted in the housing 11 are stored in the memory unit 54. As described below, the control unit 50 controls the transport unit 16 such that an amount of banknotes stored in each of the banknote storages 30 and the banknote storage cassette 40 does not exceed the maximum capacity stored in the memory unit 54. That is, the control unit 50 controls the transport unit 16 such that a banknote is not transported to each banknote storage 30 or the banknote storage cassette 40 in which an amount of stored banknotes has reached the maximum capacity stored in the memory unit 54. Alternatively, the control unit 50 may control the transport unit 16 such that a banknote is not transported to each banknote storage 30 or the banknote storage cassette 40 immediately before an amount of stored banknotes reaches the maximum capacity stored in the memory unit 54. Moreover, the control unit 50 can transmit a signal to and receive a signal from an external device (specifically, for example, a higher-ranking terminal) provided separately from the banknote handling machine 10 of the present embodiment, through the communication interface unit 56.

Furthermore, as shown in FIG. 2, in the banknote handling machine 10 according to the present embodiment, a maximum capacity change unit 58 that changes the maximum capacity, of each banknote storage 30 or the banknote storage cassette 40, stored in the memory unit 54, is connected to the control unit 50. The maximum capacity change unit 58 changes the maximum capacity, of each banknote storage 30 or the banknote storage cassette 40, stored in the memory unit 54, on the basis of information about a kind of a banknote recognized by the recognition unit 18. A method, performed by the maximum capacity change unit 58 having such a configuration, for changing the maximum capacity, of each banknote storage 30 or the banknote storage cassette 40, stored in the memory unit 54, will be described below in detail.

Furthermore, the banknote handling machine 10 of the present embodiment can handle a hybrid banknote in which paper and a polymer film are combined, in addition to a standard banknote formed merely from paper. A structure of such a hybrid banknote will be described with reference to FIG. 3. As shown in FIG. 3, a hybrid banknote (represented as reference character P in FIG. 3) is formed by a polymer film portion $P_2$ that extends linearly along the short edge direction of the banknote being sandwiched between paired paper portions $P_1$. Such a hybrid banknote is also regarded as a normal banknote in some countries and regions. Therefore, in a case where the recognition unit 18 performs recognition of a banknote, when a hybrid banknote as shown in FIG. 3 is recognized, the control unit 50 determines that such a hybrid banknote is a normal banknote.

Furthermore, when the recognition unit 18 recognizes a hybrid banknote, the recognition unit 18 detects a position, in the width direction, of the polymer film portion $P_2$ of the hybrid banknote. The method performed by the recognition unit 18 for detecting a position, in the width direction, of the polymer film portion $P_2$ of the hybrid banknote will be described with reference to FIG. 4. FIG. 4 illustrates a method performed by the recognition unit 18 for detecting a position, in the width direction, of the polymer film portion $P_2$ of the hybrid banknote. As shown in FIG. 4, a banknote is divided into a plurality (for example, 8) of detection regions $a_0$ to $a_7$ in the width direction, and the recognition unit 18 determines whether or not the polymer film portion $P_2$ is in each of the detection regions $a_0$ to $a_7$ when the recognition unit 18 recognizes the banknote. Among the detection regions $a_0$ to $a_7$, the detection regions $a_0$ to $a_2$ are left-side regions of the banknote in the width direction, the detection regions $a_3$, $a_4$ are center regions of the banknote in the width direction, and the detection regions $a_5$ to $a_7$ are right-side regions of the banknote in the width direction. In a case where the polymer film portion $P_2$ of the hybrid banknote recognized by the recognition unit 18 is at a position as shown in FIG. 4, it is detected that the polymer film portion $P_2$ is in the detection region $a_6$, whereby it is detected that the polymer film portion $P_2$ is on the right side of the banknote in the width direction.

The polymer film portion $P_2$ of such a hybrid banknote or a portion, of the hybrid banknote, to which the polymer film portion $P_2$ is adhered, has a stronger stiffness than the paper portion $P_1$, and, furthermore, the thickness of the polymer film portion $P_2$ or the thickness of the portion, of the hybrid banknote, to which the polymer film portion $P_2$ is adhered is greater than the thickness of the paper portion $P_1$. Therefore, conventional art has a problem that an amount of hybrid banknotes stored in a tape-type or stacker-type storage unit is reduced as compared to a stored amount of conventional banknotes formed merely from paper. Thus, in a case where the maximum capacity (specifically, the maximum capacity for conventional banknotes formed merely from paper) for banknotes is set for a storage unit of a conventional banknote handling machine, the same amount of hybrid banknotes as an amount of conventional banknotes formed merely from paper cannot be stored in the storage unit, and, when a large amount of hybrid banknotes are to be stored in the storage unit, trouble such as overflow of banknotes from the storage unit may occur.

Meanwhile, in the banknote handling machine 10 of the present embodiment, as described above, the recognition unit 18 determines whether or not a banknote transported by the transport unit 16 is a hybrid banknote, and the maximum capacity change unit 58 changes the maximum capacity, of each banknote storage 30 or the banknote storage cassette 40, stored in the memory unit 54, on the basis of a result of the determination by the recognition unit 18. Specifically, the maximum capacity change unit 58 changes the maximum capacity stored in the memory unit 54 for each banknote storage 30 or the banknote storage cassette 40, on the basis of a proportion between an amount of hybrid banknotes stored in the banknote storage 30 or the banknote storage cassette 40, and an amount of banknotes (that is, conventional banknotes formed merely from paper) other than the hybrid banknotes. The method performed by the maximum capacity change unit 58 for changing the maximum capacity of each banknote storage 30 or the banknote storage cassette 40 will be described with reference to the table shown in FIG. 6.

In a case where the banknote handling machine 10 of the present embodiment is installed in a store or the like, information (that is, an initial value of the maximum capacity) indicating that the maximum capacity of each banknote storage 30 is initially set as, for example, 500, is stored in the memory unit 54. As indicated in the table shown in FIG. 6, while depositing of banknotes is performed by the banknote handling machine 10, when the proportion of the hybrid banknotes stored in the banknote storage 30 is increased, the maximum capacity, of the banknote storage 30, stored in the memory unit 54 is reduced. When depositing of banknotes is performed by the banknote handling machine 10, the recognition unit 18 determines whether or not the banknote transported by the transport unit 16 is a hybrid banknote, and the proportion of the hybrid banknotes stored in the banknote storage 30 is calculated on the basis of the result of the determination by the recognition unit 18. As indicated in the table shown in FIG. 6, each time the proportion of the hybrid banknotes stored in the banknote storage 30 is increased by increment of, for example, 10%, the maximum capacity, of the banknote storage 30, stored in the memory unit 54 is reduced by, for example, 30. Thus, when the proportion of the hybrid banknotes stored in the banknote storage 30 exceeds, for example, 50%, the maximum capacity, of the banknote storage 30, stored in the memory unit 54 is reduced to 350. Furthermore, when the proportion of the hybrid banknotes stored in the banknote storage 30 is, for example, 100%, the maximum capacity, of the banknote storage 30, stored in the memory unit 54 is reduced to 200. Thus, in a case where depositing of banknotes is performed by the banknote handling machine 10, when the proportion of the hybrid banknotes stored in the banknote storage 30 is increased, the maximum capacity, of the banknote storage 30, stored in the memory unit 54 is reduced. Therefore, in a case where the hybrid banknotes are not stored in the banknote storage 30, the maximum capacity of the banknote storage 30 can be relatively increased, and even when the proportion of the hybrid banknotes stored in the banknote storage 30 is increased, trouble such as overflow of banknotes from the banknote storage 30 can be inhibited.

The method performed by the maximum capacity change unit 58 for changing the maximum capacity of each banknote storage 30 or the banknote storage cassette 40 is not limited to the above-described method. Various other methods can be used. For example, when the banknote handling machine 10 of the present embodiment is installed in a store or the like, information (that is, an initial value of the maximum capacity) indicating that the maximum capacity of each banknote storage 30 is initially set as, for example, 350 is stored in the memory unit 54. In a case where an amount of banknotes stored in one of the banknote storages 30 reaches the maximum capacity (that is, 350) stored in the memory unit 54, when the number of hybrid banknotes stored in the one of the banknote storages 30 is not greater than a predetermined number (for example, 20), the maximum capacity change unit 58 may increase the maximum capacity of the one of the banknote storages 30 to, for example, 450. In a case where an amount of banknotes stored in the banknote storage 30 reaches the changed maximum capacity (that is, 450) stored in the memory unit 54, when the number of hybrid banknotes stored in the banknote storage 30 is not greater than another predetermined number (for example, 10), the maximum capacity change unit 58 may further increase the maximum capacity of the banknote storage 30 from 450 (increase the maximum capacity to, for example, 500). Such a method performed by the maximum capacity change unit 58 for changing the maximum capacity of each banknote storage 30 or the banknote storage cassette 40 is also one mode in which the maximum capacity stored in the memory unit 54 is changed by the maximum capacity change unit 58, on the basis of a proportion between an amount of hybrid banknotes stored in each banknote storage 30 or the banknote storage cassette 40, and an amount of banknotes (that is, conventional banknotes formed merely from paper) other than the hybrid banknotes.

Furthermore, instead of the table shown in FIG. 6 being used, a relational expression representing a relationship between: a proportion between an amount of hybrid banknotes stored in each banknote storage 30 or the banknote storage cassette 40 and an amount of stored banknotes other than the hybrid banknotes; and the maximum capacity of the banknote storage 30 or the banknote storage cassette 40 may be stored in the memory unit 54, and, when the maximum capacity change unit 58 changes the maximum capacity, of the banknote storage 30 or the banknote storage cassette 40, stored in the memory unit 54, the maximum capacity change unit 58 may change the maximum capacity of the banknote storage 30 or the banknote storage cassette 40 by using the relational expression.

Furthermore, the maximum capacity change unit 58 may change the maximum capacity, of each banknote storage 30 or the banknote storage cassette 40, stored in the memory unit 54, on the basis of a difference between: an amount of hybrid banknotes stored in the banknote storage 30 or the banknote storage cassette 40; and an amount of stored banknotes (that is, conventional banknotes formed merely from paper) other than the hybrid banknotes. For example, when the banknote handling machine 10 of the present embodiment is installed in a store or the like, information (that is, an initial value of the maximum capacity) indicating that the maximum capacity of each banknote storage 30 is initially set as, for example, 350 is stored in the memory unit 54. Each time a difference obtained by subtracting an amount of stored hybrid banknotes from an amount of banknotes, stored in the banknote storage 30, other than the hybrid banknotes, reaches a multiple of a predetermined number (for example, 50) that is not less than 0, the maximum capacity change unit 58 may increase the maximum capacity, of the banknote storage 30, stored in the memory unit 54 by a predetermined number (for example, 15). Furthermore, each time a difference obtained by subtracting an amount of stored hybrid banknotes from an amount of banknotes, stored in the banknote storage 30, other than the hybrid banknotes reaches a multiple of a predetermined number (for example, 20) that is not greater than 0, the maximum capacity change unit 58 may reduce the maximum capacity, of the banknote storage 30, stored in the memory unit 54 by a predetermined number (for example, 15).

Furthermore, the maximum capacity change unit 58 may change the maximum capacity, of each banknote storage 30 or the banknote storage cassette 40, stored in the memory unit 54, on the basis of an amount of the hybrid banknotes stored in the banknote storage 30 or the banknote storage cassette 40. For example, when the banknote handling machine 10 of the present embodiment is installed in a store or the like, information (that is, an initial value of the maximum capacity) indicating that the maximum capacity of each banknote storage 30 is initially set as, for example, 500 is stored in the memory unit 54. Each time an amount of the hybrid banknotes stored in the banknote storage 30 reaches a multiple of a predetermined number (for example, 10), the maximum capacity change unit 58 may reduce the maximum capacity, of the banknote storage 30, stored in the memory unit 54 by a predetermined number (for example, 30). Moreover, in another exemplary method, when an amount of the hybrid banknotes stored in each banknote storage 30 or the banknote storage cassette 40 reaches a predetermined amount, the maximum capacity change unit 58 may change the maximum capacity, of the banknote storage 30 or the banknote storage cassette 40, stored in the memory unit 54 (specifically, reduces the maximum capacity). The predetermined amount may be, for example, one. In this case, for example, even when only one hybrid banknote is stored in one of the banknote storages 30, the maximum capacity change unit 58 reduces the maximum capacity of the one of the banknote storages 30. Moreover, the predetermined amount is not limited to one, and the predetermined amount may be, for example, 100 or 200.

Next, an operation performed by the banknote handling machine 10 having the above-described structure when depositing of banknotes is performed, will be described with reference to the flow chart shown in FIG. 5. The operation by the banknote handling machine 10 as described below is performed by the control unit 50 controlling the components of the banknote handling machine 10.

In a case where depositing of banknotes is performed by the banknote handling machine 10, when an operator inserts a plurality of banknotes in the inlet unit 12, and thereafter provides the control unit 50 with an instruction for starting depositing through the operation/display unit 52, the banknotes inserted in the inlet unit 12 are fed one by one into the housing 11 by the banknote feeding mechanism 12*a*, and transported one by one by the transport unit 16 (STEP1). For each banknote transported by the transport unit 16, the recognition unit 18 performs recognition of a denomination, authenticity, face/back, fitness/unfitness, new/old version, a transport state, and the like (STEP2). Furthermore, at this time, the recognition unit 18 determines whether or not the banknote transported by the transport unit 16 is a hybrid banknote. Banknotes recognized as being not normal banknotes by the recognition unit 18, that is, rejected banknotes are transported to the discharge unit 14 by the transport unit 16, and stacked in the discharge unit 14 ("NO" in STEP3 and STEP5). Thus, the operator is allowed to manually take out the rejected banknotes stacked in the discharge unit 14, from the housing 11, and place again the banknotes in the inlet unit 12. Meanwhile, a banknote recognized as a normal banknote by the recognition unit 18 is transported to the temporary storage unit 20 by the transport unit 16, and temporarily stored in the temporary storage unit 20 ("YES" in STEP3 and STEP4).

The above-described operation in STEP1 to STEP5 is repeated until all the banknotes inserted in the inlet unit 12 are fed into the housing 11 and transported to the temporary storage unit 20 or the discharge unit 14 ("NO" in STEP6). When all the banknotes inserted in the inlet unit 12 are fed into the housing 11 and transported to the temporary storage unit 20 or the discharge unit 14 ("YES" in STEP6), a message that requires the operator to confirm the depositing is displayed on the operation/display unit 52. Thereafter, when the operator provides the control unit 50 with an instruction for confirming the depositing, through the operation/display unit 52 ("YES" in STEP7), the banknotes are fed one by one from the temporary storage unit 20 into the transport unit 16 (STEP8). In a case where an amount of banknotes stored in the banknote storage 30 (specifically, the banknote storage 30 corresponding to the denomination of the banknote fed from the temporary storage unit 20 into the transport unit 16) to which the banknote fed from the temporary storage unit 20 into the transport unit 16 is to be transported does not reach the maximum capacity stored in the memory unit 54 ("NO" in STEP9), that is, in a case where the banknote storage 30 corresponding to the denomination of the banknote fed from the temporary storage unit 20 into the transport unit 16 is not full, the banknote is transported to the banknote storage 30 by the transport unit 16 and stored in the banknote storage 30 (STEP10). Furthermore, each time a banknote is stored in the banknote storage 30, the maximum capacity change unit 58 changes the maximum capacity of the banknote storage 30 on the basis of the kind (specifically, information indicating whether or not each banknote stored in the banknote storage 30 is a hybrid banknote) of the banknote stored in the banknote storage 30 (STEP11). The method performed by the maximum capacity change unit 58 for changing the maximum capacity of the banknote storage 30 is as described above. Meanwhile, in a case where an amount of banknotes stored in the banknote storage 30 to which the banknote fed from the temporary storage unit 20 into the transport unit 16 is to be transported reaches the maximum capacity stored in the memory unit 54 ("YES" in STEP9), that is, in a case where the banknote storage 30 corresponding to the denomination of the banknote fed from the temporary storage unit 20 into the transport unit 16 is full, the banknote is transported to a portion (for example, the banknote storage cassette 40 or the discharge unit 14) other than the banknote storage 30 by the transport unit 16 (STEP12). When all the banknotes that are temporarily stored in the temporary storage unit 20 are fed from the temporary storage unit 20 and stored in the banknote storages 30 and the like ("YES" in STEP13), a series of depositing of banknotes performed by the banknote handling machine 10 is completed.

In the operation in STEP8 to STEP10 described above, after the banknotes are fed one by one from the temporary storage unit 20 into the transport unit 16, the banknotes may be stored in the banknote storage cassette 40 as well as the banknote storages 30. Specifically, in a case where a denomination of a banknote fed from the temporary storage unit 20 into the transport unit 16 is a predetermined denomination, the banknote may be transported to the banknote storage cassette 40 by the transport unit 16 and stored in the banknote storage cassette 40. In this case, only when an amount of banknotes stored in the banknote storage cassette 40 has not reached the maximum capacity stored in the memory unit 54, that is, only when the banknote storage cassette 40 is not full, the banknote is transported to the banknote storage cassette 40 by the transport unit 16 and stored in the banknote storage cassette 40. Furthermore, each time a banknote is stored in the banknote storage cassette 40, the maximum capacity change unit 58 changes the maximum capacity of the banknote storage cassette 40 on the basis of the kind (specifically, information indicating whether or not each banknote stored in the banknote storage cassette 40 is a hybrid banknote) of the banknote stored in the banknote storage cassette 40.

Furthermore, while depositing of banknotes is being performed by the banknote handling machine 10, the maximum capacity, of each banknote storage 30 or the banknote storage cassette 40, stored in the memory unit 54 may be displayed on the operation/display unit 52. In this case, when the maximum capacity change unit 58 changes the maximum capacity, of each banknote storage 30 or the banknote storage cassette 40, stored in the memory unit 54, a message or the like indicating that the maximum capacity has been changed may be displayed in a pop-up manner on the operation/display unit 52.

Furthermore, after all the banknotes inserted in the inlet unit 12 are fed into the housing 11 and transported to the temporary storage unit 20 or the discharge unit 14 ("YES" in STEP6), when the operator provides the control unit 50 with a returning instruction instead of providing the control unit 50 with an instruction for confirming the depositing, through the operation/display unit 52 ("NO" in STEP7 and "YES" in STEP14), the banknotes are fed one by one from the temporary storage unit 20 into the transport unit 16, and transported to the discharge unit 14 by the transport unit 16 (STEP15). Thus, the operator is allowed to take out the returned banknotes, from the discharge unit 14, to the outside of the housing 11.

A mode of the present embodiment is not limited to a mode in which the maximum capacity change unit 58 changes the maximum capacity, of each banknote storage 30 or the banknote storage cassette 40, stored in the memory unit 54, on the basis of the information indicating whether or not a banknote recognized by the recognition unit 18 is a hybrid banknote, that is, the information indicating whether or not each banknote stored in each banknote storage 30 or the banknote storage cassette 40 is a hybrid banknote. The maximum capacity change unit 58 may change the maximum capacity, of each banknote storage 30 or the banknote storage cassette 40, stored in the memory unit 54, on the basis of the information associated with a kind of a banknote other than the information indicating whether or not a banknote recognized by the recognition unit 18 is a hybrid banknote. For example, the maximum capacity change unit 58 may change the maximum capacity, of each banknote storage 30 or the banknote storage cassette 40, stored in the memory unit 54, on the basis of, for example, information indicating whether or not a banknote recognized by the recognition unit 18 is an unfit note, or information indicating whether or not a banknote recognized by the recognition unit 18 is an old version note. Specifically, when a proportion or an amount of unfit notes or old version notes stored in each banknote storage 30 or the banknote storage cassette 40 is increased, the maximum capacity change unit 58 reduces the maximum capacity of the banknote storage 30 or the banknote storage cassette 40. The reason is as follows. In a case where unfit notes or old version notes are stored in each banknote storage 30 or the banknote storage cassette 40, since such unfit notes or old version notes are, for example, wrinkled and thus become bulky in the stacking direction, an amount of unfit notes or old version notes which can be stored in the banknote storage 30 or the banknote storage cassette 40 is reduced as compared to fit notes or new version notes.

In the banknote handling machine 10 of the present embodiment having the above-described structure, and the banknote handling method performed by the banknote handling machine 10, the maximum capacity for banknotes in each banknote storage 30 or the banknote storage cassette 40 is stored in the memory unit 54, and the maximum capacity change unit 58 changes the maximum capacity stored in the memory unit 54 on the basis of the information associated with a kind of a banknote recognized by the recognition unit 18. In this case, the maximum capacity for banknotes stored in each banknote storage 30 or the banknote storage cassette 40 is changed from an initial value according to a kind of the banknote stored in the banknote storage 30 or the banknote storage cassette 40. Therefore, depositing of various kinds of banknotes can be performed, and, furthermore, trouble such as overflow of banknotes from each banknote storage 30 or the banknote storage cassette 40 can be prevented.

The maximum capacity for banknotes in the temporary storage unit 20 may be also stored in the memory unit 54, and the maximum capacity change unit 58 may change the maximum capacity, of the temporary storage unit 20, stored in the memory unit 54, on the basis of the information associated with a kind of a banknote recognized by the recognition unit 18. In this case, since the maximum capacity for banknotes stored in the temporary storage unit 20 is changed from an initial value according to a kind of the banknote stored in the temporary storage unit 20, depositing of various kinds of banknotes can be performed, and, furthermore, trouble such as overflow of banknotes from the temporary storage unit 20 can be prevented.

Furthermore, in the banknote handling machine 10 of the present embodiment, as described above, the control unit 50 controls the transport unit 16 such that an amount of banknotes stored in each banknote storage 30 or the banknote storage cassette 40 does not exceed the maximum capacity stored in the memory unit 54.

Furthermore, in the banknote handling machine 10 of the present embodiment, as described above, the recognition unit 18 determines whether or not a banknote transported by the transport unit 16 is a specific kind of banknote, and the maximum capacity change unit 58 changes the maximum capacity stored in the memory unit 54 on the basis of a proportion between: an amount of the specific kind of banknotes stored in each banknote storage 30 or the banknote storage cassette 40; and an amount of stored banknotes other than the specific kind of banknotes. For example, when the recognition unit 18 detects a predetermined specific portion (specifically, for example, the polymer film portion $P_2$) included in a banknote transported by the transport unit 16, the recognition unit 18 determines that the banknote (that is, hybrid banknote) is a specific kind of banknote. In the banknote handling machine 10 of the present embodiment, the specific kind of banknote is not limited to a hybrid banknote, and an unfit note, an old version note, or the like may be preset as the specific kind of banknote.

Furthermore, in the banknote handling machine 10 of the present embodiment, as described above, the maximum capacity change unit 58 may change the maximum capacity stored in the memory unit 54 on the basis of a difference between: an amount of a specific kind of banknotes stored in each banknote storage 30 or the banknote storage cassette 40; and an amount of stored banknotes other than the specific kind of banknotes. In another example, the maximum capacity change unit 58 may change the maximum capacity stored in the memory unit 54 on the basis of an amount of a specific kind of banknotes stored in each banknote storage 30 or the banknote storage cassette 40. In this case, the maximum capacity change unit 58 may change the maximum capacity stored in the memory unit 54 when an amount of the specific kind of banknotes stored in each banknote storage 30 or the banknote storage cassette 40 has reached a predetermined amount.

Furthermore, in the banknote handling machine 10 of the present embodiment, as described above, the operation/display unit 52 that displays information (for example, the maximum capacity for banknotes in each banknote storage 30 or the banknote storage cassette 40) stored in the memory unit 54, may be provided. In this case, when the maximum capacity stored in the memory unit 54 is changed, information indicating that the maximum capacity stored in the memory unit 54 has been changed may be displayed on the operation/display unit 52.

The banknote handling machine 10 and the banknote handling method performed by the banknote handling machine 10 according to the present embodiment are not limited to ones as described above, and various modifications thereto can be made.

For example, in the banknote handling machine 10 of the present embodiment, when depositing of banknotes is performed, banknotes inserted into the housing 11 by the inlet unit 12 may be transported directly (that is, without temporarily storing the banknotes in the temporary storage unit 20) to the banknote storages 30 for each denomination and stored in the banknote storages 30, instead of banknotes inserted into the housing 11 by the inlet unit 12 being temporarily stored in the temporary storage unit 20 and then transported to the banknote storages 30 for each denomination and stored in the banknote storages 30.

Furthermore, in a banknote handling machine 10 according to modification, the recognition unit 18 also detects a face/back orientation of a banknote transported by the transport unit 16 or the orientation, in the short edge direction, of the banknote, and, only when the recognition unit 18 detects that a banknote transported by the transport unit 16 includes a predetermined specific portion (specifically, the polymer film portion $P_2$) and detects that the face/back orientation of the banknote or the orientation, in the short edge direction, of the banknote is a predetermined orientation, the recognition unit 18 may determine that the banknote is a specific kind of banknote. As shown in FIG. 3, in a hybrid banknote, the polymer film portion $P_2$ that extends linearly along the short edge direction of the banknote is not disposed at the center position in the long edge direction of the banknote but disposed leftward or rightward of the center position. Therefore, when a plurality of hybrid banknotes in which the face/back orientation of the banknotes or the orientation, in the short edge direction, of the banknotes is a predetermined orientation, are stacked in each banknote storage 30 or the banknote storage cassette 40, the hybrid banknotes become bulky in the stacking direction. In other words, in a case where a hybrid banknote in which the face/back orientation of the banknote or the orientation, in the short edge direction, of the banknote is not a predetermined orientation, is stored in each banknote storage 30 or the banknote storage cassette 40, a position, in the long edge direction, of the polymer film portion $P_2$ of the hybrid banknote is different from a position, in the long edge direction, of the polymer film portion $P_2$ of a hybrid banknote in which the face/back orientation of the banknote or the orientation, in the short edge direction, of the banknote is a predetermined orientation. Thus, even if a hybrid banknote in which the face/back orientation of the banknote or the orientation, in the short edge direction, of the banknote is not a predetermined orientation, is stored in each banknote storage 30 or the banknote storage cassette 40, hybrid banknotes do not become greatly bulky in the stacking direction. Therefore, the recognition unit 18 may not determine that a hybrid banknote in which the face/back orientation of the banknote or the orientation, in the short edge direction, of the banknote is not a predetermined orientation, is a specific kind of banknote.

Figure 7:
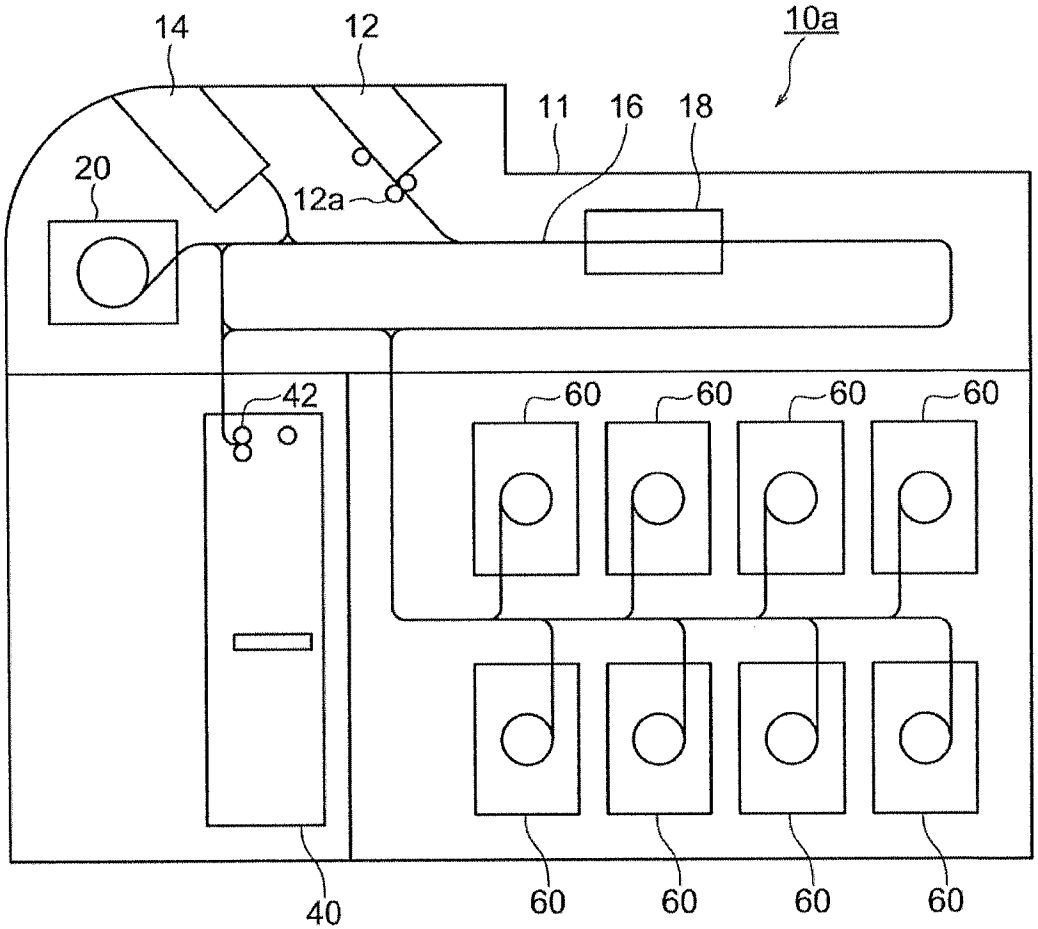
FIG. 7 schematically illustrates a structure of a banknote handling machine according to modification.

Furthermore, as the banknote handling machine of the present embodiment, a banknote handling machine having a structure as shown in FIG. 7 may be used. In a banknote handling machine 10*a* according to modification as shown in FIG. 7, a tape-type storage/feeding unit 60 in which banknotes are wound around the outer circumferential surface of a drum by using a bank-like tape is provided as a storage unit for storing banknotes, instead of the stacker-type banknote storage 30 in which a plurality of banknotes are stacked in a layered state being provided. Specifically, in the banknote handling machine 10*a* according to the modification, as shown in FIG. 7, a plurality (specifically, 8) of storage/feeding units 60 are connected to the transport unit 16, and banknotes are transported to the storage/feeding units 60 for each denomination by the transport unit 16 and stored in the storage/feeding units 60, and the banknotes stored in each storage/feeding unit 60 are fed one by one from the storage/feeding unit 60 into the transport unit 16.

In a case where the tape-type storage/feeding unit 60, in which banknotes are wound around the outer circumferential surface of a drum by using a band-like tape, is used, if a large amount of hybrid banknotes are stored in the storage/feeding unit 60, since the polymer film portion $P_2$ of each hybrid banknote or a portion, of the hybrid banknote, to which the polymer film portion $P_2$ is adhered has a stronger stiffness than the paper portion $P_1$, when the hybrid banknote is wound around the outer circumferential surface of the drum by using the band-like tape, a problem arises that a force, with which the hybrid banknote is fastened onto the outer circumferential surface of the drum by the tape, is reduced as compared to a case where a banknote formed merely from paper is wound around the outer circumferential surface of the drum by the band-like tape. Furthermore, in a case where a plurality of band-like tapes are aligned along the axial direction of the drum, a fastening force of a tape, among the plurality of the tapes, closer to the polymer film portion $P_2$ of the hybrid banknote becomes lower than a fastening force of a tape, among the plurality of tapes, farther from the polymer film portion $P_2$. In this case, when a plurality of hybrid banknotes are wound around the outer circumferential surface of the drum, a portion, of the tapes, closer to the polymer film portion $P_2$ of the hybrid banknote is expanded outward of the drum, whereby the plurality of hybrid banknotes that are wound around the outer circumferential surface of the drum by each tape form a so-called conical shape as seen in the direction orthogonal to the axis of the drum, and positions of the hybrid banknotes stored on the drum may deviate in the axial direction of the drum.

Meanwhile, in the banknote handling machine 10*a* according to the modification as shown in FIG. 7, similarly to the banknote handling machine 10 as shown in FIG. 1 and the like, the maximum capacity for banknotes in each storage/feeding unit 60 is stored in the memory unit 54, and the maximum capacity change unit 58 changes the maximum capacity stored in the memory unit 54 on the basis of the information about a kind of a banknote recognized by the recognition unit 18. In this case, the maximum capacity for banknotes stored in each storage/feeding unit 60 is changed from an initial value on the basis of a kind (that is, information indicating whether or not each banknote stored in each storage/feeding unit 60 is a hybrid banknote) of a banknote stored in the storage/feeding unit 60. Therefore, depositing of various kinds of banknotes can be performed, and, furthermore, trouble such as overflow of banknotes from each storage/feeding unit 60 can be prevented.

More specifically, in the banknote handling machine 10*a* according to the modification as shown in FIG. 7, the recognition unit 18 determines whether or not a banknote transported by the transport unit 16 is a specific kind of banknote (specifically, for example, hybrid banknote), and the maximum capacity change unit 58 changes the maximum capacity stored in the memory unit 54 on the basis of, for example, a proportion or a difference between an amount of hybrid banknotes stored in each storage/feeding unit 60, and an amount of stored banknotes other than the hybrid banknotes. Also in the banknote handling machine 10*a* according to the modification as shown in FIG. 7, the specific kind of banknote is not limited to a hybrid banknote, and, for example, an unfit note or old version note may be set as the specific kind of banknote.

Figure 8:
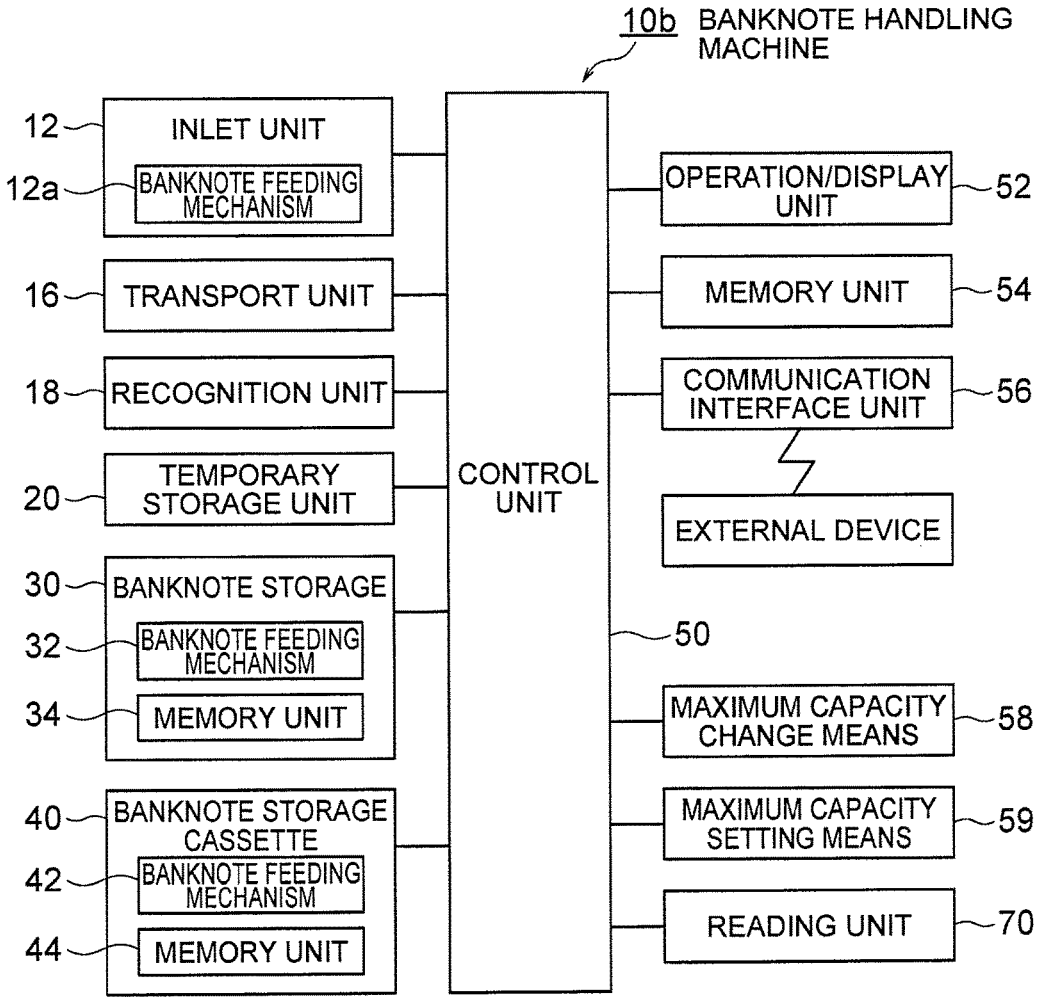
FIG. 8 is a functional block diagram illustrating a configuration of a control system of a banknote handling machine according to another modification.

Furthermore, in a banknote handling machine according to another modification, the banknote storage 30 as well as the banknote storage cassette 40 may be removable from the housing 11. A configuration of a control system of the banknote handling machine according to this modification will be described with reference to FIG. 8. In a banknote handling machine 10*b* according to this modification, as shown in FIG. 8, instead of the maximum capacity for banknotes in each banknote storage 30 or the banknote storage cassette 40 being stored in the memory unit 54 provided in the housing 11, each banknote storage 30 and the banknote storage cassette 40 are provided with memory units 34 and 44 such as memories, respectively, and the memory units 34 and 44 store the maximum capacities of banknotes in each banknote storage 30 and the banknote storage cassette 40 having the memory units 34 and 44, respectively. Furthermore, in this case, in a portion, of the housing 11 of the banknote handling machine 10*b*, at which each banknote storage 30 or the banknote storage cassette 40 is mounted, a reading unit 70 that reads information stored in the memory unit 34, 44 provided in each banknote storage 30 or the banknote storage cassette 40, is provided.

Furthermore, the banknote handling machine 10*b* that allows each banknote storage 30 to be removable from the housing 11 may be structured such that a portion of the plurality of the banknote storages 30 mounted in the housing 11 is used for storing hybrid banknotes, and another portion of the plurality of the banknote storages 30 mounted in the housing 11 is not used for storing hybrid banknotes. In this case, in the memory unit 34 provided in each banknote storage 30, information indicating whether or not the banknote storage 30 is used for storing hybrid banknotes is stored. Furthermore, the maximum capacity stored in the memory unit 34 provided in the banknote storage 30 that is used for storing hybrid banknotes is less than the maximum capacity stored in the memory unit 34 provided in the banknote storage 30 that is not used for storing hybrid banknotes. Specifically, the maximum capacity stored in the memory unit 34 provided in the banknote storage 30 that is not used for storing hybrid banknotes is, for example, 500, whereas the maximum capacity stored in the memory unit 34 provided in the banknote storage 30 that is used for storing hybrid banknotes is, for example, 400. The polymer film portion $P_2$ of a hybrid banknote or a portion, of a hybrid banknote, to which the polymer film portion $P_2$ is adhered, has a stronger stiffness than the paper portion $P_1$. Furthermore, the thickness of the polymer film portion $P_2$ or the thickness of the portion to which the polymer film portion $P_2$ is adhered is greater than the thickness of the paper portion $P_1$. Therefore, in a case where hybrid banknotes are stored in the banknote storage 30 having the same size as the banknote storage 30 in which conventional banknotes formed merely from paper are stored, the same amount of hybrid banknotes as an amount of the conventional banknotes formed merely from paper cannot be stored in the banknote storage 30. Therefore, the maximum capacity stored in the memory unit 34 provided in the banknote storage 30 that is used for storing hybrid banknotes needs to be less than the maximum capacity stored in the memory unit 34 provided in the banknote storage 30 that is not used for storing hybrid banknotes.

Moreover, in the banknote handling machine 10*b* according to this modification as shown in FIG. 8, information indicating whether or not each banknote storage 30 mounted in the housing 11 is used for storing hybrid banknotes may be displayed on the operation/display unit 52 on the basis of information read by the reading unit 70.

In the banknote handling machine 10*b* as described above, when banknotes that are temporarily stored in the temporary storage unit 20 are transported to the banknote storages 30 for each denomination by the transport unit 16, banknotes recognized as hybrid banknotes by the recognition unit 18 are transported to the banknote storage 30 that is used for storing hybrid banknotes, whereas banknotes recognized as being not hybrid banknotes by the recognition unit 18 are transported to the banknote storage 30 that is not used for storing hybrid banknotes. The maximum capacities of the banknote storages 30 are set to be different according to whether or not the banknote storage 30 is used for storing hybrid banknotes. Therefore, an amount of banknotes stored in the banknote storage 30 which is not used for storing hybrid banknotes can be increased as compared to a case where hybrid banknotes and the other banknotes are stored in the banknote storage 30 in a mixed state. Furthermore, trouble such as overflow of banknotes from the banknote storage 30 that is used for storing hybrid banknotes can be inhibited.

Furthermore, in the banknote handling machine 10*b* that allows each banknote storage 30 to be removable from the housing 11, instead of the maximum capacities of banknotes in each banknote storage 30 and the banknote storage cassette 40 being stored in the memory units 34 and 44 provided in the banknote storage 30 and the banknote storage cassette 40, respectively, identification information of each banknote storage 30 and the banknote storage cassette 40 may be stored in the memory units 34, 44. In this case, the memory units 34 and 44 function as identification terminals that allow each banknote storage 30 and the banknote storage cassette 40, respectively, to be identified. The identification information, of each banknote storage 30 or the banknote storage cassette 40, stored in the memory unit 34, 44, may include information indicating whether or not the banknote storage 30 or the banknote storage cassette 40 is used for storing hybrid banknotes. Furthermore, the banknote handling machine 10*b* is provided with a maximum capacity setting unit 59 that sets the maximum capacity of each banknote storage 30 or the banknote storage cassette 40 on the basis of the identification information, of the banknote storage 30 or the banknote storage cassette 40, read by the reading unit 70, and stores the maximum capacity in the memory unit 54. Specifically, the maximum capacity setting unit 59 sets the maximum capacities to be stored in the memory unit 54 such that the maximum capacity of each banknote storage 30 that is used for storing hybrid banknotes is less than the maximum capacity of each banknote storage 30 which is not used for storing hybrid banknotes. Furthermore, in the banknote handling machine 10*b* as described above, the identification information, of each banknote storage 30 or the banknote storage cassette 40, read by the reading unit 70 may be displayed on the operation/display unit 52.

Also in the banknote handling machine 10*b* as described above, when banknotes that are temporarily stored in the temporary storage unit 20 are transported to the banknote storages 30 for each denomination by the transport unit 16, banknotes recognized as hybrid banknotes by the recognition unit 18 are transported to the banknote storage 30 that is used for storing hybrid banknotes, whereas banknotes recognized as being not hybrid banknotes by the recognition unit 18 are transported to the banknote storage 30 that is not used for storing hybrid banknotes. The maximum capacities of the banknote storages 30 are set by the maximum capacity setting unit 59 so as to be different according to whether or not the banknote storage 30 is used for storing hybrid banknotes. Therefore, an amount of banknotes stored in the banknote storage 30 which is not used for storing hybrid banknotes can be increased as compared to a case where hybrid banknotes and the other banknotes are stored in the banknote storage 30 in a mixed state. Furthermore, trouble such as overflow of banknotes from the banknote storage 30 that is used for storing hybrid banknotes can be inhibited. As the identification terminal that allows each banknote storage 30 or the banknote storage cassette 40 to be identified, for example, a barcode or the like may be used, or the identification number of each banknote storage 30 or the banknote storage cassette 40 may be written directly on the outer surface of the banknote storage 30 or the banknote storage cassette 40, instead of the memory unit 34, 44 being used. In a case where a barcode or the like is used as the identification terminal, for example, a barcode reader is used as the reading unit 70, whereby the control unit 50 of the banknote handling machine 10*b* can obtain identification information of each banknote storage 30 or the banknote storage cassette 40. Furthermore, in a case where the identification number that is written directly on the outer surface of each banknote storage 30 or the banknote storage cassette 40 is used as the identification terminal, for example, an imaging camera is used as the reading unit 70, whereby the control unit 50 of the banknote handling machine 10*b* can obtain the identification information of each banknote storage 30 or the banknote storage cassette 40.

Figure 9:
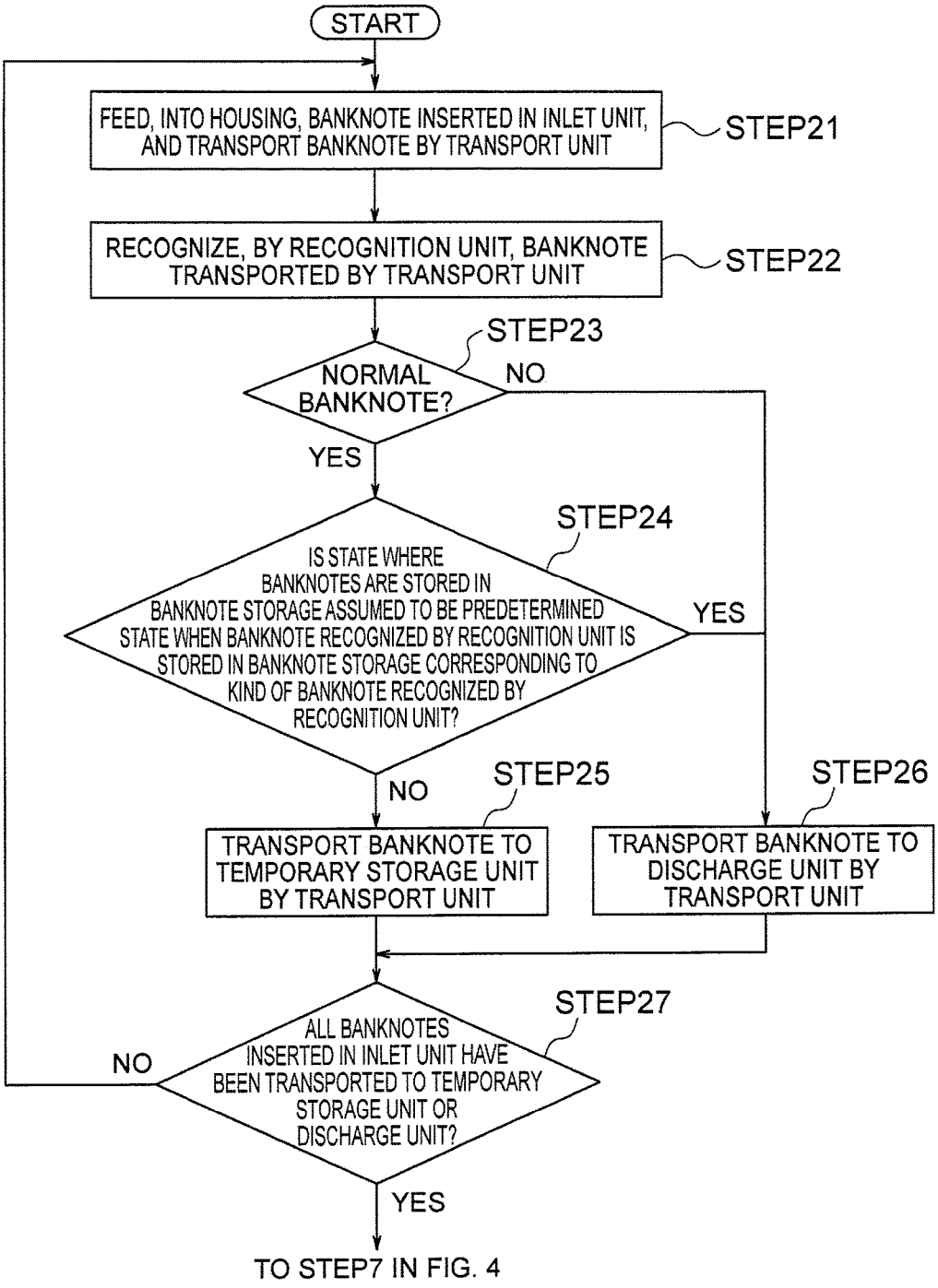
FIG. 9 is a flow chart showing another example of an operation performed by the banknote handling machine shown in FIG. 1 when depositing of banknotes is performed.

Furthermore, an operation performed by the banknote handling machine 10 shown in FIG. 1 when depositing of banknotes is performed is not limited to the operation shown in the flow chart in FIG. 5. When depositing of banknotes is performed by the banknote handling machine 10 shown in FIG. 1, an operation shown in a flow chart in FIG. 9 may be performed. A mode in which the operation shown in the flow chart in FIG. 9 is performed by the above-described banknote handling machine 10 shown in FIG. 1 when depositing of banknotes is performed, will be described below. The operation by the banknote handling machine 10 as described below is also performed by the control unit 50 controlling the components of the banknote handling machine 10.

In a case where depositing of banknotes is performed by the banknote handling machine 10, when an operator inserts a plurality of banknotes in the inlet unit 12, and thereafter provides the control unit 50 with an instruction for starting depositing through the operation/display unit 52, the banknotes inserted in the inlet unit 12 are fed one by one into the housing 11 by the banknote feeding mechanism 12*a*, and transported one by one by the transport unit 16 (STEP21). For each banknote transported by the transport unit 16, the recognition unit 18 performs recognition of a denomination, authenticity, face/back, fitness/unfitness, new/old version, a transport state, and the like (STEP22). Banknotes recognized as being not normal banknotes by the recognition unit 18, that is, rejected banknotes are transported to the discharge unit 14 by the transport unit 16, and stacked in the discharge unit 14 ("NO" in STEP23 and STEP26). Thus, the operator is allowed to manually take out the rejected banknotes stacked in the discharge unit 14, from the housing 11, and place again the banknotes in the inlet unit 12. The banknote handling machine 10 that performs the operation shown in the flow chart in FIG. 9, may be provided with a reject unit (not shown) for rejecting banknotes (that is, rejected banknotes) recognized as being not normal banknotes by the recognition unit 18, instead of the discharge unit 14 being provided in the banknote handling machine 10. In this case, banknotes (that is, rejected banknotes) recognized as being not normal banknotes by the recognition unit 18 are transported to the reject unit by the transport unit 16 and stacked in the reject unit.

Furthermore, in the banknote handling machine 10 that performs the operation shown in the flow chart in FIG. 9, an operation of transporting a banknote recognized by the recognition unit 18, to the temporary storage unit 20, is selectively regulated by the control unit 50 on the basis of information associated with the maximum capacity, of each banknote storage 30, stored in the memory unit 54, an amount of banknotes stored in each banknote storage 30, and a kind of a banknote that is temporarily stored in the temporary storage unit 20. Specifically, in a case where a banknote has been recognized by the recognition unit 18, when the banknote is to be stored in the banknote storage 30 corresponding to the kind (specifically, for example, denomination of the banknote) of the banknote, if a state where banknotes are stored in the banknote storage 30 is assumed to be a predetermined state (specifically, fully occupied state) ("YES" in STEP24), the banknote is transported to the discharge unit 14 by the transport unit 16 and stacked in the discharge unit 14 (STEP26). More specifically, in a case where a vacant capacity for banknotes in one of the banknote storages 30 is, for example, 100, and 100 banknotes of the denomination corresponding to the one of the banknote storages 30 are already stored temporarily in the temporary storage unit 20, when the recognition unit 18 recognizes a banknote corresponding to the denomination, the banknote recognized by the recognition unit 18 is not transported to the temporary storage unit 20 but transported to the discharge unit 14. The reason is as follows. If the banknote corresponding to the denomination is transported from the recognition unit 18 to the temporary storage unit 20 in such a case, the number of banknotes, corresponding to the denomination, stored temporarily in the temporary storage unit 20 is not less than 101. Thus, when the banknotes that is temporarily stored in the temporary storage unit 20 are transported to the banknote storage 30, the banknote storage 30 is fully occupied before all the banknotes are fed from the temporary storage unit 20, all the banknotes recognized by the recognition unit 18 cannot be stored in the banknote storage 30 corresponding to the denomination of the banknotes, and a part of a plurality of banknotes that are temporarily stored in the temporary storage unit 20 needs to be stored in another one of the banknote storages 30 or needs to be rejected. Particularly when a banknote handling machine does not have a storage, such as the banknote storage cassette 40, for storing banknotes that have overflowed, there is no choice but to reject the banknotes, and this problem becomes more significant. Therefore, in a case where a banknote has been recognized by the recognition unit 18, when the banknote is to be stored in the banknote storage 30 corresponding to the denomination of the banknote, if a state where banknotes are stored in the banknote storage 30 is assumed to be a predetermined state (specifically, fully occupied state), the banknote recognized by the recognition unit 18 is not transported to the temporary storage unit 20. Thus, overflow of banknotes from the banknote storage 30 can be inhibited when banknotes that are temporarily stored in the temporary storage unit 20 are transported to the banknote storages 30. In a case where a banknote has been recognized by the recognition unit 18, when the banknote is to be stored in the banknote storage 30 corresponding to the denomination of the banknote, if a state where banknotes are stored in the banknote storage 30 is not assumed to be a predetermined state (specifically, fully occupied state) ("NO" in STEP24), the banknote is transported to the temporary storage unit 20 by the transport unit 16, and temporarily stored in the temporary storage unit 20 (STEP25).

In the banknote handling machine 10, performing the operation shown in the flow chart in FIG. 9, which is provided with the reject unit (not shown) instead of the discharge unit 14, in a case where a banknote has been recognized by the recognition unit 18, when the banknote is to be stored in the banknote storage 30 corresponding to the kind (specifically, for example, denomination of the banknote) of the banknote, if a state where banknotes are stored in the banknote storage 30 is assumed to be a predetermined state (specifically, fully occupied state), the banknote is transported to the reject unit by the transport unit 16 and stacked in the reject unit.

The above-described operation in STEP21 to STEP25 is repeated until all the banknotes inserted in the inlet unit 12 are fed into the housing 11 and transported to the temporary storage unit 20 or the discharge unit 14 ("NO" in STEP27). When all the banknotes inserted in the inlet unit 12 are fed into the housing 11 and transported to the temporary storage unit 20 or the discharge unit 14 ("YES" in STEP27), a message that requires the operator to confirm the depositing is displayed on the operation/display unit 52. Thereafter, almost the same operation as the operation in STEP7 to STEP15 shown in FIG. 4 is performed.

Thus, in the banknote handling machine 10 that performs the operation shown in the flow chart in FIG. 9, an operation of transporting a banknote recognized by the recognition unit 18, to the temporary storage unit 20, is selectively regulated by the control unit 50 on the basis of information associated with the maximum capacity, of each banknote storage 30, stored in the memory unit 54, an amount of banknotes stored in each banknote storage 30, and a kind of a banknote that is temporarily stored in the temporary storage unit 20. In this case, an amount of banknotes that are temporarily stored in the temporary storage unit 20 can be inhibited from being greater than a vacant capacity of the banknote storage 30. Therefore, banknotes that are temporarily stored in the temporary storage unit 20 can be assuredly stored in the banknote storage 30 without, for example, rejecting the banknotes. Specifically, when a banknote recognized by the recognition unit 18 is to be stored in the banknote storage 30 corresponding to the kind (specifically, for example, denomination of the banknote) of the banknote, if a state where banknotes are stored in the banknote storage 30 is assumed to be a predetermined state (specifically, fully occupied state), the control unit 50 controls the transport unit 16 such that the banknote of the kind recognized by the recognition unit 18 is not transported to the temporary storage unit 20.

As another exemplary method, performed by the banknote handling machine 10 performing the operation shown in the flow chart in FIG. 9, in which the control unit 50 controls the transport unit 16, a method may be provided in which, in a case where a banknote has been recognized by the recognition unit 18, when the banknote is to be stored in the banknote storage 30 corresponding to the kind (specifically, for example, denomination of the banknote) of the banknote, if a state where banknotes are stored in the banknote storage 30 is assumed to be a predetermined state (for example, fully occupied state), the banknote recognized by the recognition unit 18 is not transported to the temporary storage unit 20 regardless of the kind of the banknote recognized by the recognition unit 18. Also in this case, an amount of banknotes that are temporarily stored in the temporary storage unit 20 can be inhibited from being greater than the vacant capacity of the banknote storage 30. Therefore, banknotes that are temporarily stored in the temporary storage unit 20 can be assuredly stored in the banknote storage 30 without, for example, rejecting the banknotes.

Furthermore, in the banknote handling machine 10 that performs the operation shown in the flow chart in FIG. 9, in a case where a banknote has been recognized by the recognition unit 18, when the banknote is to be stored in the banknote storage 30 corresponding to the kind (specifically, for example, denomination of the banknote) of the banknote, if a state where banknotes are stored in the banknote storage 30 is assumed to be a predetermined state (specifically, fully occupied state), the control unit 50 may cause the banknote feeding mechanism 12*a* to stop feeding banknotes from the inlet unit 12. In this case, by stopping the operation itself of feeding banknotes into the housing 11, an amount of banknotes that are temporarily stored in the temporary storage unit 20 can be inhibited from being greater than the vacant capacity of the banknote storage 30.

In the above description for the banknote handling machine 10, 10*a*, 10*b* according to the present embodiment, the maximum capacity and a stored amount in each banknote storage 30, the banknote storage cassette 40, or the like are not limited to the number of banknotes, and may be a monetary amount of banknotes. Furthermore, in the above description, as an amount of banknotes stored in each banknote storage 30, the banknote storage cassette 40, or the like, a proportion relative to the maximum capacity may be used.

Furthermore, in the banknote handling machine 10, 10*a*, 10*b* described above, each banknote storage 30, the banknote storage cassette 40, or the like may be provided with a full state detection sensor that detects that the banknote storage 30 or the banknote storage cassette 40 is fully occupied with banknotes. In this case, when the full state detection sensor detects that each banknote storage 30 or the banknote storage cassette 40 is fully occupied with banknotes, the control unit 50 controls the transport unit 16 such that banknotes are not transported to the corresponding banknote storage 30 and banknote storage cassette 40.

Furthermore, in the banknote handling machine 10, 10*a*, 10*b* described above, after banknotes inserted in the inlet unit 12 are fed one by one into the housing 11 by the banknote feeding mechanism 12*a*, and sent to the transport unit 16, when the banknotes are transported to the recognition unit 18 by the transport unit 16 and recognized by the recognition unit 18, if the recognition unit 18 determines that a plurality of banknotes are continuously skewed, information indicating that hybrid banknotes are continuously skewed may be output by the control unit 50. In a brand-new hybrid banknote (that is, new note that has not yet been circulated in the market), the polymer film portion $P_2$ has a coefficient of friction which is higher than a coefficient of friction of the other portion (specifically, the paper portion $P_1$) of the hybrid banknote, as compared to a hybrid banknote that is circulated in the market. Therefore, when a brand-new hybrid banknote inserted in the inlet unit 12 is fed into the housing 11 by the banknote feeding mechanism 12*a*, such a brand-new hybrid banknote may be greatly skewed. Meanwhile, once a brand-new hybrid banknote has been touched by a hand even once, or once is has been transported in the housing 11 even once by the transport unit 16, the coefficient of friction of the polymer film portion $P_2$ is reduced. Therefore, in a case where a brand-new hybrid banknote, which is recognized by the recognition unit 18 as being skewed and is transported to the discharge unit 14 as a rejected banknote, is inserted again in the inlet unit 12, the banknote can be sent to the transport unit 16 without greatly skewing the banknote when the banknote is fed into the housing 11 by the banknote feeding mechanism 12*a*.

In accordance with such a technical matter, in the banknote handling machines 10, 10*a*, 10*b* according to the modifications, in a case where the recognition unit 18 determines that a plurality of banknotes are continuously skewed, it is assumed that a plurality of brand-new hybrid banknotes are inserted collectively in the inlet unit 12, and the information indicating that the hybrid banknotes are continuously skewed is output by the control unit 50. When the information is output by the control unit 50, a message that requires an operator to insert again the banknotes transported to the discharge unit 14, in the inlet unit 12, is displayed on the operation/display unit 52. In this case, even in a case where a plurality of brand-new hybrid banknotes are inserted collectively in the inlet unit 12, and the recognition unit 18 determines that a plurality of banknotes are continuously skewed, if the hybrid banknotes transported to the discharge unit 14 as rejected banknotes are inserted again in the inlet unit 12 and fed into the housing 11 by the banknote feeding mechanism 12*a*, the hybrid banknotes can be sent to the transport unit 16 without greatly skewing the banknotes when the banknote feeding mechanism 12*a* performs an operation of feeding the hybrid banknotes. Therefore, even when the recognition unit 18 determines that a plurality of banknotes are continuously skewed, an operator is not confused and is more likely to set again the hybrid banknotes transported to the discharge unit 14 as rejected banknotes, in the inlet unit 12.

In the banknote handling machines 10, 10*a*, 10*b* according to the modifications, the number of times representing the continuous number of skewings of a plurality of banknotes is preset, and when the number of times the recognition unit 18 continuously determines that banknotes are skewed reaches the preset number, information indicating that hybrid banknotes are continuously skewed is output by the control unit 50. Furthermore, the present number may be variable. Moreover, when the information indicating that hybrid banknotes are continuously skewed is output by the control unit 50, the information may be stored in the memory unit 54 as a log. In this case, an operator is allowed to distinguish between occurrence of skewing of brand-new hybrid banknotes and occurrence of skewing of banknotes due to the other reason, on the basis of the log stored in the memory unit 54.

Furthermore, in a banknote handling machine according to still another modification, a face/back reversing unit that reverses the face and the back of a banknote may be provided in the transport unit. In this case, when a hybrid banknote is stored in a tape-type temporary storage unit or banknote storage unit in which a banknote is wound around the outer circumferential surface of a drum by using a tape, the face/back reversing unit may reverse the face and the back of the hybrid banknote before the hybrid banknote is transported to the tape-type temporary storage unit or banknote storage unit such that positions (that is, positions in the left-right direction in FIG. 3), in the long edge direction of the hybrid banknote, of the polymer film portions $P_2$ of hybrid banknotes to be wound around the drum alternate. In such a banknote handling machine, the polymer film portions $P_2$ of a plurality of hybrid banknotes wound around the outer circumferential surface of the drum can be prevented from being stacked at a specific position, in the long edge direction, of the hybrid banknotes. Thus, a plurality of hybrid banknotes wound around the outer circumferential surface of the drum by the tapes can be inhibited from forming a so-called conical shape, as seen in the direction orthogonal to the axis of the drum. Therefore, a position of the hybrid banknote stored in the drum can be prevented from deviating in the axial direction of the drum.

Furthermore, as a banknote handled by the banknote handling machine according to the present embodiment, a banknote which is entirely formed from a polymer film portion may be used. In this case, when the recognition unit recognizes a banknote which is entirely formed from the polymer film portion, the recognition unit determines that the banknote is a specific kind of banknote.

Furthermore, the paper sheet handling machine and the paper sheet handling method performed by the paper sheet handling machine according to the present invention are not limited to the banknote handling machine 10, 10*a*, 10*b* that performs various handling such as depositing of banknotes as described above, and the banknote handling method performed by the banknote handling machine 10, 10*a*, 10*b*. The paper sheet handling machine and the paper sheet handling method performed by the paper sheet handling machine according to the present invention may be a paper sheet handling machine that handles paper sheets other than banknotes, such as securities, checks, and tickets, and a paper sheet handling method for handling paper sheets other than banknotes, such as securities, checks, and tickets.

The invention claimed is:

1. A sheet handling machine comprising:

an inlet unit configured to feed a sheet into the machine;

a transport unit configured to transport the sheet that is fed into the machine by the inlet unit;

a recognition unit configured to recognize a kind of the sheet transported by the transport unit as at least a first kind or a second kind;

a storage unit configured to store the sheet recognized by the recognition unit, the storage unit being removable from the machine;

a memory unit configured to store a maximum capacity which is an amount of sheets to be stored at a maximum in the storage unit, the memory unit being provided at the storage unit and storing a first maximum capacity as an initial setting value;

a maximum capacity change unit configured to change the maximum capacity stored in the memory unit from the first maximum capacity to a second maximum capacity, on the basis of a proportion of an amount of the first kind of sheets stored in the storage unit to an amount of the second kind of sheets stored in the storage unit;

a control unit configured to control the transport unit such that an amount of sheets stored in the storage unit does not exceed the second maximum capacity stored in the memory unit; and a reading unit configured to read information stored in the memory unit when the storage unit is mounted to the machine.

2. The sheet handling machine according to claim 1, wherein, when the recognition unit detects that the sheet transported by the transport unit is a hybrid sheet having a first portion including paper and a second portion including a specific material other than paper, the recognition unit determines that the sheet is the first kind of sheet, and when the recognition unit detects that the sheet transported by the transport unit is a paper sheet, the recognition unit determines that the sheet is the second kind of sheet.

3. The sheet handling machine according to claim 2, wherein, the specific material is a material that includes polymer.

4. The sheet handling machine according to claim 1, wherein a plurality of storage units are provided as the storage unit, the plurality of storage units include a first storage unit that is used for storing the first kind of sheets and a second storage unit that is not used for storing the first kind of sheets, and the maximum capacity stored in the memory unit provided at the first storage unit is less than the maximum capacity stored in the memory unit provided at the second storage unit.

5. The sheet handling machine according to claim 1, wherein, an identification terminal that allows the storage unit to be identified is provided at the storage unit, and the reading unit is configured to read identification information of the identification terminal when the storage unit is mounted to the machine, and the sheet handling machine further comprises:

a maximum capacity setting unit configured to set the maximum capacity to be stored in the memory unit, on the basis of the identification information read by the reading unit.

6. The sheet handling machine according to claim 5, wherein the identification information of the identification terminal includes information indicating whether or not the first kind of sheets can be stored, and the maximum capacity setting unit sets the maximum capacity to be stored in the memory unit such that the maximum capacity of the storage unit that is used for storing the first kind of sheets is less than the maximum capacity of the storage unit which is not used for storing the first kind of sheets.

7. The sheet handling machine according to claim 1, further comprising a display unit configured to display information stored in the memory unit.

8. The sheet handling machine according to claim 7, wherein, when the maximum capacity stored in the memory unit is changed, information indicating that the maximum capacity stored in the memory unit has been changed is displayed on the display unit.

9. The sheet handling machine according to claim 1, wherein the control unit controls the transport unit to transport the sheet from the transport unit to the storage unit until the storage amount of the sheet stored in the storage unit reaches the second maximum capacity, and after the storage amount of the sheet stored in the storage unit reaches the second maximum capacity stored in the storage unit, the control unit controls the transport unit to transport the sheet from the transport unit to a portion of the machine other than the storage unit.

10. A sheet handling machine comprising:

an inlet unit configured to feed a sheet into the machine;

a transport unit configured to transport the sheet that is fed into the machine by the inlet unit;

a recognition unit configured to recognize a kind of the sheet transported by the transport unit as at least a first kind or a second kind;

a memory unit configured to store a maximum capacity, which is an amount of sheets to be stored at a maximum in the storage unit, the memory unit being provided at the storage unit and storing a first maximum capacity as an initial setting value;

a storage unit configured to store the sheet recognized by the recognition unit, the storage unit being removable from the machine;

a maximum capacity change unit configured to change the maximum capacity stored in the memory unit from the first maximum capacity to a second maximum capacity, on the basis of a difference between an amount of the first kind of sheets stored in the storage unit and an amount of the second kind of sheets stored in the storage unit;

a control unit configured to control the transport unit such that an amount of sheets stored in the storage unit does not exceed the second maximum capacity stored in the memory unit; and a reading unit configured to read information stored in the memory unit when the storage unit is mounted to the machine.

11. The sheet handling machine according to claim 10, wherein the maximum capacity change unit changes the maximum capacity stored in the memory unit from the first maximum capacity to the second maximum capacity when an amount of the first kind of sheets stored in the storage unit reaches a predetermined amount.

12. The sheet handling machine according to claim 10, wherein, when the recognition unit detects that the sheet transported by the transport unit is a hybrid sheet having a first portion including paper and a second portion including a specific material other than paper, the recognition unit determines that the sheet is the first kind of sheet, and when the recognition unit detects that the sheet transported by the transport unit is a paper sheet, the recognition unit determines that the sheet is the second kind of sheet.

13. The sheet handling machine according to claim 10, wherein a plurality of storage units are provided as the storage unit, the plurality of storage units include a first storage unit that is used for storing the first kind of sheets and a second storage unit that is not used for storing the first kind of sheets, and the maximum capacity stored in the memory unit provided at the first storage unit is less than the maximum capacity stored in the memory unit provided at the second storage unit.

14. The sheet handling machine according to claim 10, wherein, an identification terminal that allows the storage unit to be identified is provided at the storage unit, and the reading unit is configured to read identification information of the identification terminal when the storage unit is mounted to the machine, and the sheet handling machine further comprises:

a maximum capacity setting unit configured to set the maximum capacity to be stored in the memory unit on the basis of the identification information read by the reading unit.

15. A sheet handling machine comprising:

an inlet unit configured to feed a sheet into the machine;

a transport unit configured to transport the sheet that is fed into the machine by the inlet unit;

a recognition unit configured to recognize a kind of the sheet transported by the transport unit as at least a first kind or a second kind;

a storage unit configured to store the sheet recognized by the recognition unit, the storage unit being removable from the machine;

a memory unit configured to store a maximum capacity which is an amount of sheets to be stored at maximum in the storage unit, the memory unit being provided at the storage unit and storing a first maximum capacity as an initial setting value;

a maximum capacity change unit configured to change the maximum capacity stored in the memory unit from the first maximum capacity to a second maximum capacity, on the basis of an amount of the first kind of sheets stored in the storage unit;

a control unit configured to control the transport unit such that an amount of sheets stored in the storage unit does not exceed the second maximum capacity stored in the memory unit; and a reading unit configured to read information stored in the memory unit when the storage unit is mounted to the machine.

16. The sheet handling machine according to claim 15, wherein the maximum capacity change unit changes the maximum capacity stored in the memory unit from the first maximum capacity to the second maximum capacity when an amount of the first kind of sheets stored in the storage unit reaches a predetermined amount.

17. The sheet handling machine according to claim 15, wherein, when the recognition unit detects that the sheet transported by the transport unit is a hybrid sheet having a first portion including paper and a second portion including a specific material other than paper, the recognition unit determines that the sheet is the first kind of sheet, and when the recognition unit detects that the sheet transported by the transport unit is a paper sheet, the recognition unit determines that the sheet is the second kind of sheet.

18. The sheet handling machine according to claim 15, wherein a plurality of storage units are provided as the storage unit, the plurality of storage units include a first storage unit that is used for storing the first kind of sheets and a second storage unit that is not used for storing the first kind of sheets, and the maximum capacity stored in the memory unit provided at the first storage unit is less than the maximum capacity stored in the memory unit provided at the second storage unit.

19. The sheet handling machine according to claim 15, wherein, an identification terminal that allows the storage unit to be identified is provided at the storage unit, and the reading unit is configured to read identification information of the identification terminal when the storage unit is mounted to the machine, and the sheet handling machine further comprises:

a maximum capacity setting unit configured to set the maximum capacity to be stored in the memory unit on the basis of the identification information read by the reading unit.

* * * * *